US010146169B2

(12) United States Patent
Aoyama et al.

(10) Patent No.: US 10,146,169 B2
(45) Date of Patent: Dec. 4, 2018

(54) CLEANING BLADE, PROCESS CARTRIDGE, AND IMAGE FORMING APPARATUS

(71) Applicants: Yuka Aoyama, Kanagawa (JP); Keiichiro Juri, Kanagawa (JP); Masanobu Gondoh, Kanagawa (JP); Yohta Sakon, Kanagawa (JP); Masahiro Ohmori, Kanagawa (JP); Yuuki Mizutani, Kanagawa (JP)

(72) Inventors: Yuka Aoyama, Kanagawa (JP); Keiichiro Juri, Kanagawa (JP); Masanobu Gondoh, Kanagawa (JP); Yohta Sakon, Kanagawa (JP); Masahiro Ohmori, Kanagawa (JP); Yuuki Mizutani, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/648,644

(22) Filed: Jul. 13, 2017

(65) Prior Publication Data

US 2018/0017930 A1 Jan. 18, 2018

(30) Foreign Application Priority Data

Jul. 15, 2016 (JP) ..... 2016-140219
Oct. 24, 2016 (JP) ..... 2016-207764
Jun. 29, 2017 (JP) ..... 2017-126918

(51) Int. Cl.
*G03G 21/00* (2006.01)

(52) U.S. Cl.
CPC ..... *G03G 21/0017* (2013.01)

(58) Field of Classification Search
CPC ..... G03G 21/0017; G03G 21/0011
See application file for complete search history.

(56) References Cited

U.S. PATENT DOCUMENTS 5,450,184 A 9/1995 Yanai et al.
6,030,733 A 2/2000 Kami et al.
6,060,205 A 5/2000 Takeichi et al.
(Continued)

FOREIGN PATENT DOCUMENTS

JP 2962843 8/1999
JP 2004-233818 8/2004
(Continued)

OTHER PUBLICATIONS

U.S. Appl. No. 08/879,992, filed Jun. 20, 1997.

*Primary Examiner* — Sandra Brase
(74) *Attorney, Agent, or Firm* — Cooper & Dunham LLP

(57) ABSTRACT

A cleaning blade including an elastic member configured to be in contact with a surface of a cleaning-target member to remove deposited matter deposited on the surface of the cleaning-target in member, wherein the elastic member includes a base and a surface layer formed of a cured product of a curable composition, the surface layer is formed on at least part of a bottom surface of the base including a contact part to be in contact with the cleaning-target member, where the bottom surface of the base is a surface of the base facing a downstream side along a traveling direction of the cleaning-target member relative to the contact part, and an average film thickness of the surface layer at the contact part is 10 μm or greater but 100 μm or less.

12 Claims, 17 Drawing Sheets

(56) References Cited

U.S. PATENT DOCUMENTS

| | | | |
|---|---|---|---|
| 6,151,468 | A | 11/2000 | Kami et al. |
| 6,160,977 | A | 12/2000 | Takeichi et al. |
| 6,363,237 | B1 | 3/2002 | Nagame et al. |
| 6,521,386 | B1 | 2/2003 | Sakon et al. |
| 6,558,862 | B2 | 5/2003 | Kojima et al. |
| 6,562,529 | B1 | 5/2003 | Kojima et al. |
| 8,369,769 | B2 | 2/2013 | Ohmori et al. |
| 8,526,864 | B2 | 9/2013 | Nakagawa et al. |
| 8,644,753 | B2 | 2/2014 | Ohmori et al. |
| 8,867,960 | B2 | 10/2014 | Toda et al. |
| 8,897,690 | B2 | 11/2014 | Sakon et al. |
| 8,913,944 | B2 | 12/2014 | Sakon et al. |
| 9,026,015 | B2 | 5/2015 | Juri et al. |
| 9,031,491 | B2 | 5/2015 | Asano et al. |
| 9,037,067 | B2 | 5/2015 | Ikuno et al. |
| 9,046,864 | B2 | 6/2015 | Gondoh et al. |
| 9,052,631 | B2 | 6/2015 | Gohda et al. |
| 9,098,013 | B2 | 8/2015 | Yasunaga et al. |
| 9,146,524 | B2 | 9/2015 | Gohda et al. |
| 9,207,624 | B2 | 12/2015 | Toyama et al. |
| 9,244,423 | B2 | 1/2016 | Gondoh et al. |
| 9,244,424 | B1 | 1/2016 | Sakaguchi et al. |
| 9,342,031 | B2 | 5/2016 | Sakaguchi et al. |
| 9,383,713 | B2 | 7/2016 | Sakon et al. |
| 9,395,676 | B2 | 7/2016 | Sakaguchi et al. |
| 2002/0051654 | A1 | 5/2002 | Niimi et al. |
| 2002/0115005 | A1 | 8/2002 | Ikuno et al. |
| 2002/0197549 | A1 | 12/2002 | Sakon et al. |
| 2003/0049555 | A1 | 3/2003 | Sakon et al. |
| 2003/0081971 | A1 * | 5/2003 | Nakayama ..... G03G 21/0011 399/350 |
| 2003/0152854 | A1 | 8/2003 | Kojima et al. |
| 2003/0165757 | A1 | 9/2003 | Kojima et al. |
| 2004/0048178 | A1 | 3/2004 | Ikuno et al. |
| 2004/0058260 | A1 | 3/2004 | Katoh et al. |
| 2005/0238977 | A1 | 10/2005 | Kojima et al. |
| 2006/0210908 | A1 | 9/2006 | Umemura et al. |
| 2007/0287083 | A1 | 12/2007 | Gondoh et al. |
| 2008/0112742 | A1 | 5/2008 | Nakamori et al. |
| 2008/0113285 | A1 | 5/2008 | Nakamori et al. |
| 2008/0219694 | A1 | 9/2008 | Nakamori et al. |
| 2009/0311017 | A1 | 12/2009 | Ohmori et al. |
| 2011/0135361 | A1 | 6/2011 | Kabata et al. |
| 2012/0237270 | A1 | 9/2012 | Juri et al. |
| 2012/0264042 | A1 | 10/2012 | Taikoji et al. |
| 2012/0315572 | A1 | 12/2012 | Mizutani et al. |
| 2013/0058685 | A1 | 3/2013 | Juri et al. |
| 2013/0137028 | A1 | 5/2013 | Matsuda et al. |
| 2013/0189012 | A1 | 7/2013 | Sakon et al. |
| 2014/0064810 | A1 | 3/2014 | Iwamoto et al. |
| 2014/0080045 | A1 | 3/2014 | Suzuki et al. |
| 2014/0270876 | A1 | 9/2014 | Yamashita et al. |
| 2014/0356042 | A1 | 12/2014 | Gondoh et al. |
| 2015/0014602 | A1 | 1/2015 | Matsushita et al. |
| 2015/0055995 | A1 | 2/2015 | Yamashita et al. |
| 2015/0071678 | A1 | 3/2015 | Ikuno et al. |
| 2015/0078777 | A1 | 3/2015 | Juri et al. |
| 2015/0078790 | A1 | 3/2015 | Ishikawa et al. |
| 2015/0117876 | A1 | 4/2015 | Sugimoto et al. |
| 2015/0139711 | A1 | 5/2015 | Gohda et al. |
| 2016/0004191 | A1 | 1/2016 | Juri et al. |
| 2016/0033925 | A1 | 2/2016 | Sakon et al. |
| 2016/0187816 | A1 | 6/2016 | Matsushita et al. |
| 2016/0202638 | A1 | 7/2016 | Takahashi et al. |
| 2016/0202639 | A1 | 7/2016 | Matsushita et al. |
| 2016/0259273 | A1 | 9/2016 | Izutani et al. |
| 2016/0274489 | A1 | 9/2016 | Juri et al. |
| 2016/0274500 | A1 | 9/2016 | Juri et al. |
| 2016/0274527 | A1 | 9/2016 | Gohda et al. |
| 2016/0320740 | A1 | 11/2016 | Toyama et al. |
| 2017/0003643 | A1 | 1/2017 | Aoyama et al. |
| 2017/0017194 | A1 | 1/2017 | Toyama et al. |

FOREIGN PATENT DOCUMENTS

| | | |
|---|---|---|
| JP | 3602898 | 10/2004 |
| JP | 2005-010761 | 1/2005 |
| JP | 2009-300751 | 12/2009 |
| JP | 2010-134310 | 6/2010 |
| JP | 2011-185984 | 9/2011 |
| JP | 2013-174858 | 9/2013 |
| JP | 5532378 | 5/2014 |
| JP | 2015-014744 | 1/2015 |
| JP | 2016-035483 | 3/2016 |
| JP | 2016-081026 | 5/2016 |

* cited by examiner

SQ100

$R_1$ : $C_nH_{2n+1}$ or $R_2$ : $C_nH_{2n+1}$ $R_3$ : $C_nH_{2n}OH$ or H

CLEANING BLADE, PROCESS CARTRIDGE, AND IMAGE FORMING APPARATUS

CROSS-REFERENCE TO RELATED APPLICATIONS

The present application claims priority under 35 U.S.C. § 119 to Japanese Patent Application No. 2016-140219 filed Jul. 15, 2016, Japanese Patent Application No. 2016-207764 filed Oct. 24, 2016, and Japanese Patent Application No. 2017-126918 filed Jun. 29, 2017. The contents of which are incorporated herein by reference in their entirety.

BACKGROUND OF THE INVENTION

Field of the Invention

The present disclosure relates to a cleaning blade, a process cartridge, and an image forming apparatus.

Description of the Related Art

It has been known in the art that deposited matter, such as unnecessary transfer toner residues, deposited on a surface of an image bearer (may be referred to as a "photoconductor," an "electrophotographic photoconductor," or an "electrostatic latent image bearer" hereinafter) serving as a cleaning-target member after transferring a toner image to transfer paper or an intermediate transfer member is removed by a cleaning unit.

As a cleaning member of the cleaning unit, use of a strip-shaped cleaning blade has been widely known because a structure of the cleaning blade can be made simple, and the cleaning blade has an excellent cleaning performance. A proximal end of the cleaning blade is supported with a supporting member, and a contact part (a distal-end ridge portion) of the cleaning blade is pressed against a peripheral surface of an image bearer to dam and scrape off the toner remaining on the image bearer to remove the toner.

In order to meet a demand for high image quality of recent years, moreover, known is an image forming apparatus using a toner formed by a polymerization method etc., and having particle shapes of small diameter and close to spheres (may be referred to as a "polymerization toner" hereinafter). The polymerization toner has characteristics that a transfer efficiency is high compared to a pulverized toner known in the art, and can meet the above-described demand. However, it is difficult to sufficiently remove the polymerization toner when removal of the polymerization toner from a surface of the image bearer is attempted. There is a problem for use of the polymerization toner that a cleaning failure is caused. This is because the polymerization toner having a small particle size and excellent sphericity is passed through a slight gap formed between the cleaning blade and the image bearer.

In order to prevent the passing through of the toner, it is desired to increase a cleaning capability through an increase in a contact pressure between the image bearer and the cleaning blade. When the contact pressure is increased, however, curling up of the cleaning blade occurs as illustrated in FIG. 14A. When the cleaning blade is used in the curled-up state, moreover, the cleaning blade is locally abraded as illustrated in FIG. 14B, and in the end, a distal-end ridge portion of the cleaning blade is broken off as illustrated in FIG. 14C.

To solve the above-described problem, for example, disclosed in Japanese Patent. No. 3602898 is an elastic member formed of a polyurethane elastomer to a contact, part of which a surface layer formed of a resin having coating hardness of B to 6H in pencil hardness is disposed.

Moreover, proposed in Japanese Unexamined Patent Application Publication No. 2004-233818 is a cleaning blade prepared by allowing an elastic member formed of rubber to impregnate with an ultraviolet ray curable composition including silicone to swell the elastic member, followed by performing an ultraviolet ray irradiation treatment to cure, the ultraviolet ray curable composition.

Moreover, proposed in Japanese Patent No. 5532378 is a cleaning blade in which a surface layer that is harder than an elastic member is formed on a surface of the elastic member including a contact part where an area including the contact part of the elastic member impregnated with at least one selected from the group consisting of an isocyanate compound, a fluorine compound, and a silicone compound.

Moreover, proposed in Japanese Patent No. 2962843 is a cleaning blade having a surface layer including lubricant particles and a binder resin.

Moreover, proposed in Japanese Unexamined Patent Application Publication No. 2009-300751 is an image forming apparatus equipped with a cleaning unit including a cleaning blade, where the cleaning blade includes an elastic body blade in a strip shape and a surface layer covering a distal-end ridge portion of the elastic body blade, the surface layer being harder than the elastic body blade and having a friction coefficient of 0.1 or greater but 0.6 or less.

SUMMARY OF THE INVENTION

According to one aspect of the present disclosure, a cleaning blade includes an elastic member configured to be in contact with a surface of a cleaning-target member to remove deposited matter deposited on the surface of the cleaning-target member. The elastic member includes a base and a surface layer formed of a cured product of a curable composition. The surface layer is formed on at least part of a bottom surface of the base including a contact part to be in contact with the cleaning-target member, where the bottom surface of the base is a surface of the base facing a downstream side along a traveling direction of the cleaning-target member relative to the contact part. An average film thickness of the surface layer at the contact part is 10 μm or greater but 100 μm or less.

DESCRIPTION OF THE EMBODIMENTS

The present disclosure has been accomplished based on the above-described background, and has an object to provide a cleaning blade that can suppress noises generated due to curling up of a ridge portion of edge, abnormal abrasion etc., and can maintain excellent cleaning performance over a long period.

The present disclosure can provide a cleaning blade that can suppress noises generated due to curling up of a ridge portion of an edge, abnormal abrasion etc., and can maintain excellent a cleaning performance over a long period.

A cleaning blade, a process cartridge, and an image forming apparatus according to the present disclosure are described with reference to drawings hereinafter. Note that, the present disclosure is not limited to embodiments described below and can be changed within a range to which a person skilled in the art can achieve, such as another embodiment, additions, modifications, and deletions. Any of embodiments may include in a scope of the present disclosure as long as the embodiments exhibit functions and effects of the present disclosure.

(Cleaning Blade)

Figure 14A:
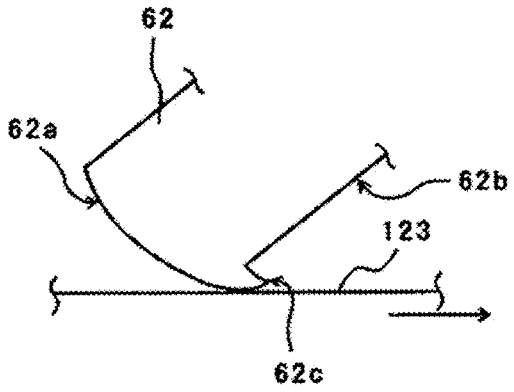
FIG. 14A is a view illustrating a state where a ridge portion of an edge of a cleaning blade known in the art is curled up.

When a polymerization toner having a small particle size and excellent sphericity is used, there is a problem that the polymerization toner passes through a slight gap formed between a cleaning blade and an image bearer. In order to prevent the passing through of the toner, it is desired to increase contact pressure between the image bearer and the cleaning blade to enhance a cleaning capability. When the contact pressure of the cleaning blade is increased, however, friction force between the image bearer 123 and the cleaning blade 62 increases. As a result, the cleaning blade 62 is pulled along the traveling direction of the image bearer 123 to curl up a distal-end ridge portion 62*c* of the cleaning blade 62, as illustrated in FIG. 14A. When the curled-up cleaning blade 62 is returned to the original state against the curl, noise may be generated.

Figure 14B:
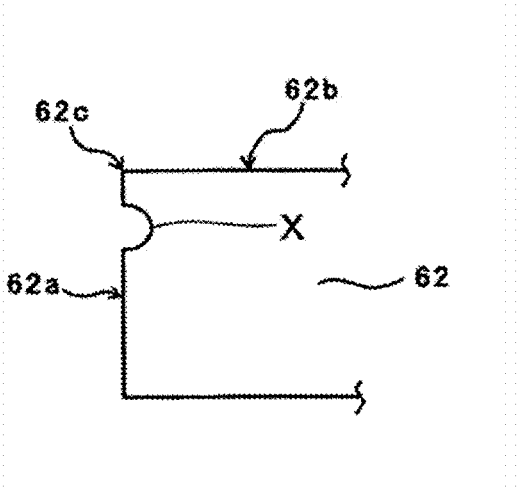
FIG. 14B is a view illustrating local abrasion of an edge surface of a cleaning blade.
Figure 14C:
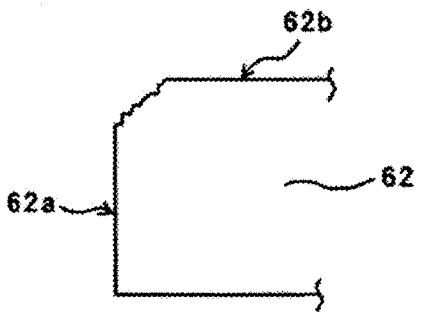
FIG. 14C is a view illustrating a state where a ridge part at an edge of a cleaning blade is broken off.

When cleaning is continued in a state where the distal-end ridge portion 62*c* of the cleaning blade 62 is curled up, moreover, abrasion is locally caused at a site that is several micrometers away from the distal-end ridge portion 62*c* of the blade edge surface 62*a* of the cleaning blade 62, as illustrated in FIG. 14B. When the cleaning is further continued in the above-mentioned state, the local abrasion increases. In the end, the distal-end ridge portion 82*c* is broken off as illustrated in FIG. 14C. When the distal-end ridge portion 82*c* is broken off as described above, there is a problem that the toner cannot be cleaned regularly to thereby cause a cleaning failure. Note that, in FIGS. 14A to 14C, 62*b* is a blade bottom surface of the cleaning blade.

Meanwhile, the cleaning blade of the present disclosure include an elastic member configured to be in contact with a surface of a cleaning-target member to remove deposited matter deposited on the surface of the cleaning-target member. The elastic member includes a base and a surface layer formed of a cured product of a curable composition. The surface layer is formed on at least part of a bottom surface of the base including a contact part to be in contact with the cleaning-target member, where the bottom surface of the base is a surface of the base facing a downstream side along a traveling direction of the cleaning-target member relative to the contact part. An average film thickness of the surface layer at the contact part is 10 μm or greater but 100 μm or less.

Figure 1:
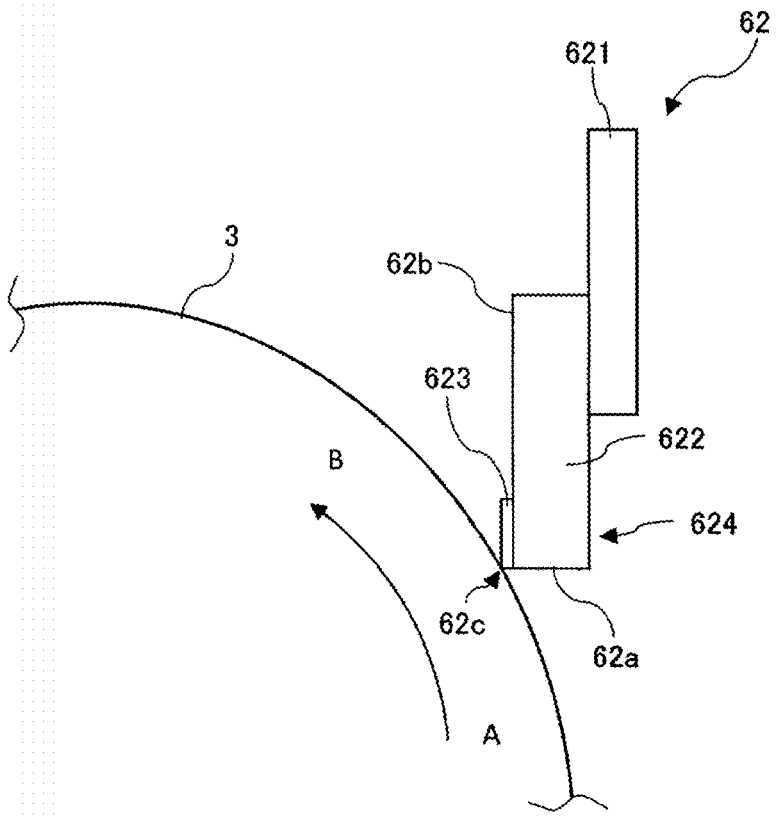
FIG. 1 is an enlarged cross-sectional view illustrating one example of a state where one example of a cleaning blade according to the present disclosure is in contact with a surface of an image bearer.
Figure 2:
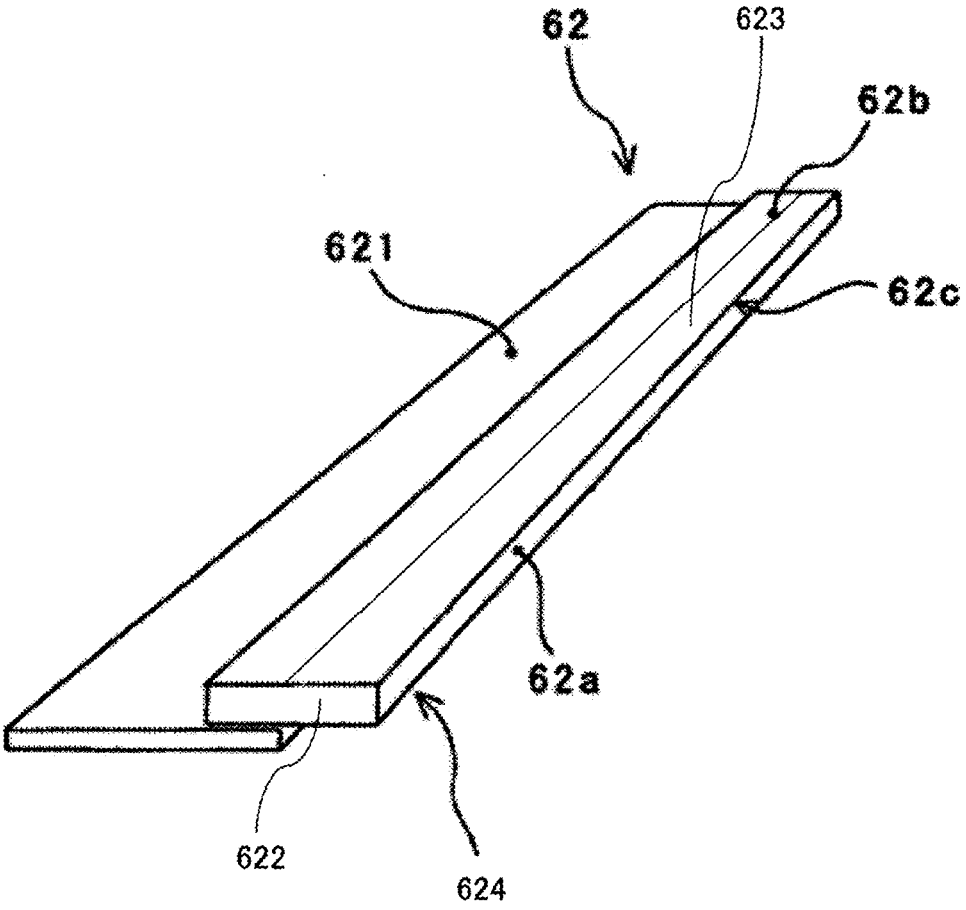
FIG. 2 is a perspective view illustrating one example of the cleaning blade according to the present disclosure.

One embodiment of the cleaning blade according to the present disclosure will be described with reference to FIGS. 1 and 2. FIG. 1 is a view describing a state where a cleaning blade 62 is in contact with a surface of a photoconductor 3 and FIG. 2 is a perspective view of the cleaning blade 62. In the cleaning blade 62 of FIGS. 1 and 2, a supporting member 621, an elastic member 624, a base 622, and a surface layer

623 are illustrated, and the base 622 of the present embodiment has a strip shape. Moreover, a blade edge surface 62*a*, a blade bottom surface 62*b*, and a distal-end ridge portion 62*c* (also referred to as a contact part or an edge part) are illustrated.

In the present disclosure, a surface of the base for forming the elastic member in a longitudinal direction, where the surface is a surface faces a downstream side of a traveling direction (a rotational direction in the present embodiment) of the cleaning-target member, is referred to as a bottom surface of the base. A surface of an edge, where the surface includes a distal-end ridge portion of the base and faces an upstream side of a rotational direction of the cleaning-target member, is referred to as an edge surface of the base.

Moreover, a surface of the elastic member in the longitudinal direction, where the surface faces the downstream side of the rotational direction of the cleaning-target member, is referred to as a blade bottom surface. A surface of an edge including a distal-end ridge portion of the elastic member, where the surface faces the upstream side of the rotational direction of the cleaning-target member is referred to as a blade edge surface.

In FIG. 1, a surface facing the downstream side B of the traveling direction of the cleaning-target member is a blade bottom surface 62*b* and a surface of an edge facing the upstream side A of the traveling direction of the cleaning-target member is a blade edge surface 62*a*.

Moreover, a contact part of the elastic member in contact with a surface of the cleaning-target member includes a distal-end ridge portion of the elastic member. In the case where the distal-end ridge portion is curled up or has high linear pressure, moreover, part of the blade edge surface can be included as the contact part.

In the present disclosure, curling up of the distal-end edge portion can be prevented and excessive stick slip can be suppressed by setting an average film thickness of the contact part of the surface layer of the cleaning blade 10 μm or greater but 100 μm or less. Since the surface layer is thick, moreover, the base of the elastic member is prevented from being exposed even when the elastic member is abraded as a result of use over a long period, to thereby prevent an increase in torque or noise. Therefore, the above-mentioned functions can be maintained. As a result, both reduction in curling up and abrasion resistance of the blade can be achieved, and an excellent cleaning performance can be maintained over a long period. Since the base of the elastic member can be prevented from being in contact with the image bearer, moreover, an increase in torque or an increase in load applied to rotations of the image bearer can be prevented. Therefore, out of color registration can be prevented, for example, in a tandem system. Note that, use of the cleaning blade of the present disclosure is not limited to a tandem system.

When the average film thickness of the contact part of the surface layer is greater than 100 μm, it is difficult to maintain flexibility of the elastic member of the base and to correspond to vibrations due to shaft shifts of the image bearer or trackability to fine waviness of a surface of the image bearer, and therefore a cleaning failure tends to occur. When the average film thickness is less than 10 μm, moreover, noise due to abnormal abrasion etc. tends to be caused.

A more preferable range of the average film thickness of the surface layer at the contact part is 12 μm or greater but 65 μm or less. Since the average film thickness is 12 μm or greater but 65 μm or less, curling up of an initial contact part is suppressed even more, the progress of abrasion can be remained within the surface layer, and the base of the elastic member can be prevented by being exposed. Therefore, curling up or noise can be prevented after use over a long period, and a cleaning failure hardly occurs.

In the present specification, the average film thickness of the surface layer of the contact part can be determined as an arithmetic mean value obtained by measuring at randomly selected 10 positions on the surface layer at the contact part.

A measuring method of a thickness of the surface layer at the contact part is not particularly limited and may be appropriately selected depending on the intended purpose. Examples of the measuring method include a method where a cross-sectional surface including the surface layer at the contact part is measured using a microscope.

Specifically, for example, a thickness of the surface layer at a position that is 5 μm away from an edge part (abutting edge) of the contact part is measured. In addition to the above, typically, the thickness is measured at a position outside portions that are 2 cm from both the edges along the longitudinal direction (a direction of the abutting edge).

<Production Method of Cleaning Blade>

Hitherto, it has been difficult to increase a film thickness of a contact part of a blade known in the art, which is produced by spraying or dip coating. The film thickness adjacent to the contact part may be 10 μm, but the film thickness at the contact part is less than a range of from 1 μm through 3 μm. In such a deposition state of the film, the contact part becomes round and therefore edge precision is poor. This may be a possible reason for impairing a cleaning performance.

In techniques in the art, for example, Japanese Patent No. 5515865, proposed is a production method of a blade including impregnation and a surface layer through cutting after impregnation, where the production method includes cutting a blade after impregnating, to thereby produce a coating film. In the above-mentioned method, the coating film is applied later, a film thickness in an edge portion becomes thin, and therefore a torque may increase over time. In Japanese Patent No. 2962843, moreover, an edge of a blade including a coating film in which lubricant particles are dispersed is cut after forming the film. However, a surface roughness is large because the lubricant particles are dispersed in the coating film, edge precision is poor even through the edge is cut after the formation of the film, and therefore a cleaning performance may be poor.

In a specific example disclosed in Japanese Unexamined Patent Application Publication No. 2009-300751, moreover, a surface layer is formed by typical spray coating. Therefore, a film thickness becomes thin at an area adjacent to an edge portion, even though a film thickness is 10 μm or greater (for example, the film, thickness is 20 μm in Example 1) at the position away from the edge portion (the position 50 μm away from the edge portion). Accordingly, the film thickness is not 10 μm or greater. As a result, the film at the edge portion is abraded over time, and the base rubber is exposed, and therefore problems, such as an increase in torque, tend to be caused.

Meanwhile, the cleaning blade 62 of the present embodiment is formed in the following manner. After coating a base 622, for example, formed of urethane rubber, with a curable composition for forming a surface layer 623, the resin is cured by ultraviolet ray irradiation or heating, followed by cutting a contact part to process into a blade shape.

The surface layer 623 is formed by covering the distal-end ridge portion 62*c* of the cleaning blade 62 with the curable composition through spray coating, dip coating, or screen printing, etc.

The surface layer disposed on the blade bottom surface can be formed by bar coating, spray coating, dip coating, brush coating, screen printing, etc. A film thickness of the surface layer can be controlled by appropriately changing conditions, such as a solid content of a coating liquid, coating conditions (bar coating: a gap, spray coating: an ejection amount, a distance, and a traveling speed, dip coating: lifting speed, etc.), coating tunes, etc.

Moreover, the surface layer formed of the cured product of the curable composition can be also formed by adhering a film of the curable composition onto the base. For example, a film of the curable composition for forming the surface layer 623 is adhered to the base 622 formed of urethane rubber through heat sealing, followed by cutting the contact part to process into a blade shape.

Part of a production method of the cleaning blade of the present embodiment is illustrated in FIGS. 3A, 3B, 3C, and 3D. FIGS. 3A, 3B, 3C, and 3D are views when the elastic member of the cleaning blade is viewed from the side.

Figure 3A:
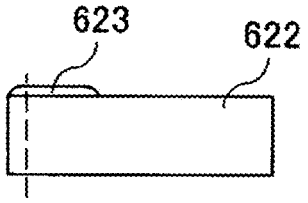
FIG. 3A is a view describing one example of a production method of the cleaning blade according to the present disclosure (part 1)
Figure 3B:
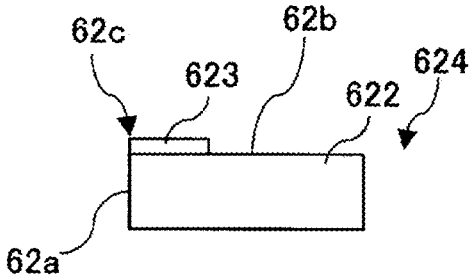
FIG. 3B is a view describing the example of the production method of the cleaning blade according to the present disclosure (part 2)

FIG. 3A illustrates a state where a curable composition is applied and cured onto the base 622, and an edge surface of the base 622 is cut as illustrated with a dashed line to produce an elastic member 624 illustrated in FIG. 3B. The cutting position can be appropriately changed. For example, the base is cut at the position that is 1 mm from the edge.

Figure 3C:
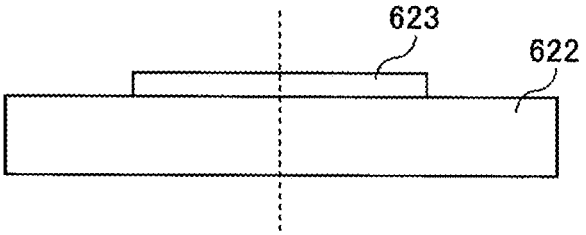
FIG. 3C is a view describing another example of a production method of the cleaning blade according to the present disclosure (part 1)
Figure 3D:
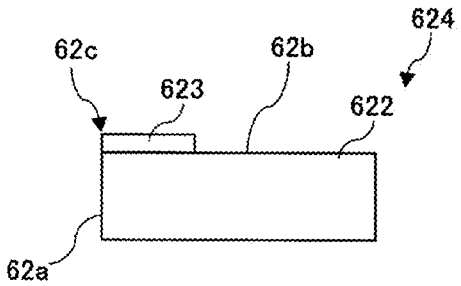
FIG. 3D is a view describing another example of the production method of the cleaning blade according to the present disclosure (part 2)

Moreover, FIGS. 3C and 3D illustrate another example. Similarly to FIG. 3A, FIG. 3C illustrates a state where a curable, composition is applied and cured onto the base 622. In FIG. 3C, the base 622 is cut at the position around a center of the base 622, not cutting at the edge surface of the base 622 as in FIG. 3A. As a result, an elastic member 524 illustrated in FIG. 3D is obtained. In this case, it is also possible to produce 2 cleaning blades at the same time.

Note that, other than the examples above, a method where a curable composition is cured using a mold to form a perpendicular contact part may be used.

A method for curing the base 622 and the surface layer 623 can be appropriately changed. For example, a vertical slicer etc. can be used.

Moreover, a cutting direction can be appropriately changed, but it is preferable that the base 622 and the surface layer 623 be cut from the side of the surface layer 623 to the side of the base 622. When the base 622 and the surface layer 623 are cut in this manner, an edge precision can be improved.

In the present embodiment, both formation of a thick film of the contact part and the edge precision can be achieved by forming a thick film on the blade bottom surface, followed by cutting the edge off. Moreover, a film having flexibility is preferable in order to form a thick film, a film causing less cure shrinkage is preferable, and use of an epoxy resin is preferable. Moreover, formation of a thick film is possible with an acrylic resin, when the acrylic resin capable of imparting flexibility and having a photobleaching effect to an initiator is used.

In order to form a thick film on the blade bottom surface using a film, use of a film formed of a material having a polyethylene skeleton is preferable. As a resin having a polyethylene skeleton, there are low-density polyethylene, high-density polyethylene, ultra-high molecular weight polyethylene, etc., but the resin having a polyethylene skeleton is more preferably high-density polyethylene or ultra-high molecular weight polyethylene in view of abrasion resistance or low friction.

<Cleaning-Target Member>

A material, shape, structure, size, etc., of the cleaning-target member are not particularly limited and may be appropriately selected depending on the intended purpose. Examples of a shape of the cleaning-target member include drum shapes, belt shapes, plate shapes, and sheet shapes. A size of the cleaning-target member is not particularly limited and may be appropriately selected depending on the intended purpose, but the size is preferably an appropriate size typically used.

A material of the cleaning-target member is not particularly limited and may be appropriately selected depending on the intended purpose. Examples of the material include metals, plastics, and ceramics.

Moreover, the cleaning-target member is not particularly limited and may be appropriately selected depending on the intended purpose. In a case where the cleaning blade is applied for an image forming apparatus, examples of the cleaning-target member include image bearers.

<Deposited Matter>

The deposited matter is not particularly limited and ma be appropriately selected depending (in the intended purpose as long as the deposited matter is deposited on a surface of a cleaning-target member and is a target for removal by the cleaning blade. Examples of the deposited matter include toners, lubricants, inorganic particles, organic particles, wastes, dusts, and mixtures of any of the foregoing. Among the above-listed examples, a toner is preferable and a low-temperature-fixing toner having a glass transition temperature of 50° C. or lower is particularly preferable.

<Supporting Member>

The cleaning blade of the present embodiment preferably includes a supporting member and a plate-shaped elastic member, one end of which is connected to the supporting member, and the other end of which has a free end having a predetermined length. The cleaning blade is arranged in a manner that a contact part of the elastic member including a distal-end ridge portion that is one end of the elastic member at the side of the free end comes in contact with a surface of the cleaning-target member along a longitudinal direction.

A shape, size, material, etc. of the supporting member are not particularly limited and may be appropriately selected depending on the intended purpose, as long as the supporting member is a member configured to support the elastic member. Examples of a shape of the supporting member include plate shapes, strip shapes, and sheet shapes. A size of the supporting member is not particularly limited and may be appropriately selected depending on a size of the cleaning-target member.

Examples of a material of the supporting member include metals, plastics, and ceramics. Among the above-listed examples, a metal plate is preferable in view of a strength and a steel plate, such as of stainless steel, an aluminium plate and a phosphor bronze plate are particularly preferable.

<Elastic Member>

The elastic member includes at least a base and a surface layer, and may further include other members according to the necessity.

<<Base>>

A shape, material, size, structure, etc. of the base of the elastic member are not particularly limited and may be appropriately selected depending on the intended purpose.

Examples of the shape include plate shapes, strip shapes, and sheet shapes.

A size of the base is not particularly limited and may be appropriately selected depending on a size of the cleaning-target member.

A material of the base is not particularly limited and may be appropriately selected depending on the intended purpose, but the material is preferably polyurethane rubber, polyurethane elastomer, etc., because high elasticity is easily obtained.

Examples of a shape of the base include a shape including a pair of plate surfaces facing each other in a thickness direction of the base, and two pairs of edge surfaces perpendicular to the plate surfaces and facing each other in the in-plane direction of the plate surfaces.

A structure of the base is not particularly limited and may be appropriately selected depending on the intended purpose. Examples of the structure include a single layer structure formed of one material, a two-layer structure where two different materials are integrally shaped, and a multi-layer structure where several different materials are integrally shaped.

When the base where two or more layers are laminated is produced, the base can be shaped integrally without causing delamination by continuously injecting raw materials of different blending ratios into a centrifugal mold before each layer is completely cured.

A material of the base is not particularly limited and may be appropriately selected depending on the intended purpose, but the material is preferably urethane rubber because high elasticity is easily obtained.

A production method of the base of the elastic member is not particularly limited and may be appropriately selected depending on the intended purpose. For example, the base is produced by preparing polyurethane prepolymer using a polyol compound and a polyisocyanate compound, adding a curing agent and optionally a curing catalyst to the polyurethane prepolymer to crosslink the prepolymer in a predetermined mold, subjecting to the prepolymer to post crosslinking in a furnace, shaping the resultant into a sheet by centrifugal casting, leaving the resultant to stand at room temperature to mature, and cutting the resultant into a plate of the predetermined size.

The polyol compound is not particularly limited and may be appropriately selected depending on the intended purpose. Examples of the polyol compound include high-molecular-weight polyols and low-molecular-weight polyols.

Examples of the high-molecular-weight polyols include: polyester polyols that are condensates between alkylene glycol and aliphatic dibasic acid; polyester-based polyols, such as polyester polyol of alkylene glycol and adipic acid (e.g., ethylene adipate ester polyol butylene adipate ester polyol hexylene adipate ester polyol, ethylenepropylene adipate ester polyol, ethylene butylene adipate ester polyol, and ethylene neopenthylene adipate ester polyol); polycaprolactone-based polyols, such as polycaprolactone ester polyol obtained by ring-opening polymerization of caprolactone; and polyether-based polyols, such as poly(oxytetramethylene)glycol and poly(oxypropylene)glycol. The above-listed examples may be used alone or in combination.

Examples of the low-molecular-weight polyol include: divalent alcohols, such as 1,4-butanediol, ethylene glycol, neopentyl hydroquinone-bis(2-hydroxyethyl) ether, 3,3'-dichloro-4,4'-diaminodiphenylmethane, and 4,4'-diaminodiphenylmethane; and trivalent or higher polyvalent alcohols, such as 1,1,1-trimethylolpropane, glycerin, 1,2,6-hexanetriol, 1,2,4-butanetriol, trimethylol ethane, 1,1,1-tris(hydroxyethoxymethyl)propane, diglycerin, and pentaerythritol. The above-listed examples may be used alone or in combination.

The polyisocyanate compound is not particularly limited and may be appropriately selected depending on the intended purpose. Examples of the polyisocyanate compound include methylene diphenyl diisocyanate (MDI), tolylene diisocyanate xylylene diisocyanate (XDI), 1,5-naphthylene diisocyanate (NDI), tetramethyl xylene diisocyanate (TMXDI), isophorone diisocyanate (IPDI), hydrogenated xylylene diisocyanate (H6XDI), dicyclohexylmethane diisocyanate (H12MDI), hexamethylene diisocyanate (HDI), dimer acid diisocyanate (DDI), norbornene diisocyanate (NBDI), and trim ethylhexamethylene diisocyanate (TMDI). The above-listed examples may be used alone or in combination.

The curing catalyst is not particularly limited and may be appropriately selected depending on the intended purpose. Examples of the curing catalyst include 2-methylimidazole and 1,2-dimethylimidazole.

An amount of the curing catalyst is not particularly limited and may be appropriately selected depending on the intended purpose. The amount is preferably 0.01% by mass or greater but 0.5% by mass or less, more preferably 0.05% by mass or greater but 0.3% by mass or less.

JIS-A hardness of the base is not particularly limited and may be appropriately selected depending on the intended purpose. The JIS-A hardness is preferably 60 degrees or greater and more preferably 65 degrees or greater but 80 degrees or less. When the JIS-A hardness is 60 degrees or greater, linear pressure of the blade is easily obtained and an area of a contact part with an image bearer is hardly increased, and therefore cleaning failures tend not to occur.

The JIS-A hardness of the base can be measured, for example, by means of a micro-rubber hardness tester MD-1 available from KOBUNSHI KEIKI CO., LTD.

Rebound resilience of the base according to the JIS K6255 standard is not particularly limited and may be appropriately selected depending on the intended purpose. The rebound resilience of the base can be measured, for example, at 23° C. by means of No. 221 resilience tester available from TOYO SEIKI SEISAKU-SHO, LTD. according to the JIS K6255 standard.

Martens hardness of the base is not particularly limited and be appropriately selected depending on the intended purpose.

The Martens hardness of the base is preferably 2.0 $N/mm^2$ or greater and more preferably 2.0 $N/mm^2$ or greater but 5.0 $N/mm^2$ or less. Since the Martens hardness of the base is 2.0 $N/mm^2$ or greater, a crack of a surface layer having a thickness of 10 μm or greater can be suppressed, hence cleaning failures tend not to occur even after use of a long period.

A measuring method of the Martens hardness (HM) is as follows.

As a measurement, for example, a microhardness meter HM-2000 available from Fischer Instruments K.K. is used.

The Vickers indenter is pressed into an edge surface of the base with a force of 1.0 mN for 10 seconds, the Vickers indenter is kept in the above-described state for 5 second, and then the Vickers indenter is pulled out with a force of 1.0 mN over 10 seconds to thereby perform a measurement.

A measuring place is a position that is 100 μm away from a distal-end ridge portion of the edge surface of the base (blade).

As a measuring method, an edge of the blade is cut, by about 2 mm, the cut piece is fixed on a glass slide with an adhesive or a double-sided tape in a manner that the edge surface faces upwards, and a position that is 100 μm from the distal-end ridge portion of the edge surface is measured.

The Martens hardness of the base may be measured in a state where the surface layer is present the blade bottom surface.

In the case where the surface layer is present on the blade edge surface, a measurement can be performed by cutting the edge surface by a razor to expose the edge surface of the base.

An average thickness of the base is not particularly limited and may be appropriately selected depending on the intended purpose. The average thickness of the base is preferably 1.0 mm or greater but 3.0 mm or less.

<Surface Layer>

In the cleaning blade of the present embodiment, a distal-end ridge portion 62*c* to be in contact with the image bearer is formed with a curable composition (not a mixed layer with the elastic member). The surface layer is not limited as long as the surface layer is formed the contact part and the blade bottom surface. The surface layer may be formed on the edge surface. Moreover, the curable composition may be included inside the elastic member. Note that, an epoxy resin is preferable as a material of the surface layer, but the material will be described together with the curable con position below.

The surface layer is preferably in a region that is apart from the distal-end ridge portion by 1 mm or greater but 7 mm or less. When the region of the surface layer is 7 mm or less, the flexibility of the elastic member becomes good and therefore trackability of the elastic member onto a photoconductor becomes improved, leading to favorable cleaning performances.

Martens hardness of the surface layer is not particularly limited and may be appropriately selected depending on the intended purpose, but the Martens hardness of the surface layer is preferably harder than the Martens hardness of the base. In this case, the Martens hardness of the surface layer is preferably 3 $N/mm^2$ or greater but 30 $N/mm^2$ or less.

When the surface layer is a member having higher hardness than the base of the elastic member, the surface layer becomes rigid and hence the surface layer hardly deforms, and as a result, curling up of the distal-end ridge portion of the cleaning blade can be suppressed.

In the present embodiment, various conditions have been diligently researched in order to control an average film thickness of a surface layer at a contact part of a cleaning blade. As a result, a film thickness of the surface layer at the contact part and edge precision of the contact part can be controlled by varying a surface formation method, flexibility of a material, or cure shrinkage at the contact part, or varying an initiator for an ultraviolet ray-curable resin. As the edge precision of the cleaning blade, a radius of curvature at the contact part is 3.5 μm or less.

A method for forming a surface layer formed of a cured product of a curable composition at the contact part of the elastic member is not particularly limited and may be appropriately selected depending on the intended purpose. Examples of the method include: a method where the curable composition is applied onto the contact part through spray coating to form a surface layer and the surface layer is cured; and a method where a film formed of a cured product of the curable composition is adhered onto the base.

A method for curing the curable composition of the surface layer formed on the contact part of the cleaning blade is not particularly limited and may be appropriately selected depending on the intended purpose. Examples of the method include treatments, such as ultraviolet ray irradiation and heating.

A device for performing irradiation of the ultraviolet rays is not particularly limited and may be appropriately selected depending on the intended purpose. Examples of the device include a device that is provided with a light source of ultraviolet rays disposed inside the device and is configured to perform irradiation of ultraviolet rays with transporting a curing target with a transporting unit, such as a conveyer.

The light source of ultraviolet rays is not particularly limited and may be appropriately selected depending on the intended purpose, as long as the light source corresponds to a polymerization initiator. Examples of the light source include lamps and UV light-emitting semiconductor elements.

Examples of the lamps include metal-halide lamps, xenon lamps, carbon arc lamps, chemical lamps, low-pressure mercury-vapor lamps, and high-pressure mercury-vapor lamps. As the lamps, commercial products can be used. Examples of the commercial products include H valve, D valve, and V valve, available from Heraeus Holding GmbH.

Examples of the UV light-emitting semiconductor elements include UV light-emitting diodes and UV light-emitting semiconductor lasers.

The ultraviolet rays for use are not particularly limited and may be appropriately selected depending on the intended purpose, as long as the ultraviolet rays for use correspond to a polymerization initiator included in the curable resin. Examples of the ultraviolet rays for use include ultraviolet rays having a wavelength of 200 nm or longer but 400 nm or shorter, far ultraviolet, rays, g-line, h-line, i-line, KrF excimer laser light, ArF excimer laser light, electron beams, X rays, molecular beams, and ion beams.

Irradiation conditions of the ultraviolet rays are not particularly limited and may be appropriately selected depending on the intended purpose. An accumulated light does is preferably 500 $mJ/cm^2$ or greater. Moreover, irradiation in more preferably performed in an inert gas (e.g., Ar, $N_2$ and $CO_2$) atmosphere in order to prevent a decrease in a curing rate due to oxygen inhibition.

An elasticity power of the cleaning blade after the modification is preferably 60% or greater but 90% or less. The elasticity power is a characteristic value determined from the accumulated stress during the measurement of Martens hardness in the following manner. The Martens hardness is measured, for example, by means of a microhardness meter while performing a motion of pressing the Vickers indenter with a constant force for 30 seconds, retaining for 5 seconds, and pulling out with a constant force for 30 seconds.

Figure 4:
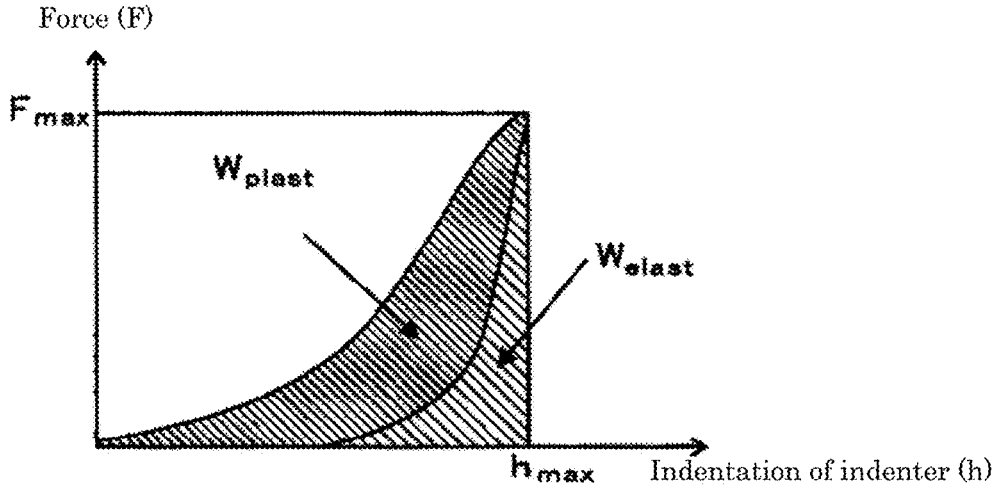
FIG. 4 is a graph describing elasticity power.

When the accumulated stress generated by pressing the Vickers indenter is determined as $W_{plast}$ and the accumulated stress generated during removing the testing load is determined $W_{elast}$, the elasticity power is a characteristic value determined by a formula of $W_{elast}/W_{plast} \times 100$ [%] (see FIG. 4). The higher the elasticity power is, the less plasticity deformation is, i.e. higher rubber properties. When the elasticity power is low, on the other hand, the state is closer to glass rather than rubber and movements of the contact part are excessively inhibited to deteriorate abrasion resistance. In the range of the Martens hardness, a (meth)acrylic resin typically has a relatively high elasticity power and a rubber state is obtained. However, the elasticity power becomes too high depending on a structure of the (meth)acrylic resin and a position of the (meth)acrylic resin as the cleaning blade may not be able to be appropriately maintained.

<Curable Composition>

The curable composition is a material where monomers or oligomers are polymerized to cure to form a cured product (solid polymer) when the monomers or oligomers receive energy such as light and heat. An energy source various depending on a type of initiators or stimuli (electron beam) for generating active species (e.g., radicals, ions, acids, and bases) that initiate polymerization. Examples of the curable composition include an ultraviolet ray-curable composition, a heat-curable composition, and an electron beam-curable composition.

A photopolymerization initiator is used for an ultraviolet ray-curable composition or an electron beam-curable composition. When the curable composition is irradiated with ultraviolet rays or electron beams, a curing reaction that can be classified as any of radical polymerization, cationic polymerization or anionic polymerization occurs, and a cured product is generated by a polymerization reaction such as vinyl polymerization, vinyl copolymerization, ring-opening polymerization, and addition polymerization.

A thermal polymerization initiator is used for a heat-curable composition. When the curable composition is heated, a curing reaction is initiated, and a cured product is generated by a polymerization reaction, such as a polymerization reaction of isocyanate, radical polymerization, epoxy ring-opening polymerization, and melamine-based condensation polymerization.

The cured product generated by the above-mentioned reaction is not particularly limited and may be appropriately selected depending on the intended purpose. Examples of the cured product include acrylic resins, phenol resins, urethane resins, cured products of epoxy resins, silicone resins, amino resins, and cured products of resins having polyethylene skeletons. A cured product of an epoxy resin is preferable because there is less cure shrinkage, and a cured product of a resin having a polyethylene skeleton is preferable because of high durability.

The epoxy resin is not particularly limited and may be appropriately selected depending on the intended purpose, but the epoxy resin is preferably a glycidyl ether-based epoxy resin. Moreover, the epoxy resin preferably includes an epoxy resin having a bisphenol A-based skeleton, and may be used in combination with a bisphenol F-based epoxy resin, a brominated bisphenol A-based epoxy resin, a hydrogenated bisphenol A-based epoxy resin, a novolac-based epoxy resin, biphenyl-based epoxy resin, etc.

When a material including the bisphenol-based epoxy resin is used, less cure shrinkage occurs and therefore a thick surface layer can be easily produced to obtain the intended film thickness. When a material including the bisphenol-based epoxy resin is used, moreover, the surface layer 623 becomes hard, and therefore a cleaning performance can be maintained over a long period without causing edge surface abrasion as in FIG. 14B as a result that the distal-end ridge portion 62*c* of the cleaning blade 62 is curled up.

Moreover, a (meth)acrylate compound in the acrylic resin is not particularly limited and may be appropriately selected depending on the intended purpose, but the (meth)acrylate compound is preferably a (meth)acrylate compound having a pentaerythritol structure within a molecule of the (meth) acrylate compound.

The (meth)acrylate compound having a pentaerythritol structure within a molecule of the (meth)acrylate compound is preferably a (meth)acrylate compound in which a functional group equivalent molecular weight is 110 or less and the number of functional groups is 3 through 6. Examples of the (meth)acrylate compound having a pentaerythritol structure within a molecule of the (meth)acrylate compound include pentaerythritol tetra(meth)acrylate pentaerythritol tri(meth)acrylate, pentaerythritol tetra(meth)acrylate pentaerythritol ethoxytetra(meth)acrylate, and dipentaerythritol hexa(meth)acrylate. Among the above-listed examples, pentaerythritol-triacrylate, pentaerythritol tetraacrylate, and dipentaerythritol hexaacrylate are preferable.

When the functional group equivalent molecular weight is 110 or less or a material having a pentaerythritol-triacylate skeleton is used, the surface layer 623 becomes hard, and therefore a cleaning performance can be maintained over a long period without causing an edge surface abrasion as in FIG. 14B as a result that the distal-end ridge portion 62*c* of the cleaning blade 62 is curled up.

An amount of the (meth)acrylate compound having a pentaerythritol structure within a molecule of the (meth) acrylate compound is not particularly limited and may be appropriately selected depending on the intended purpose. The amount based on a solid content is preferably 20% by mass or greater but 90% by mass or less, more preferably 50% by mass or greater but 80% by mass or less, relative to the curable composition.

Other than the (meth)acrylate compound having a pentaerythritol structure within a molecule of the (meth)acrylate compound, the curable composition can include a (meth) acrylate compound having a molecular weight of 100 or greater but 1,500 or less, a fluorine-based (meth)acrylate compound, and a (meth)acrylate compound having a alicyclic structure in a molecule of the (meth)acrylate compound.

Another (meth)acrylate compound having a molecular weight of 100 or greater but 1,500 or less, the fluorine-based (meth)acrylate compound, and the (meth)acrylate compound having a alicyclic structure in a molecule of the (meth)acrylate compound can be appropriately selected.

The fluorine-based (meth)acrylate compound is preferably a fluorine-based (meth)acrylate compound having a perfluoropolyether skeleton, and more preferably a fluorine-based (meth)acrylate compound having a perfluoropolyether skeleton and 2 or more functional groups.

The fluorine-based (meth)acrylate compound is not particularly limited and may be appropriately selected depending on the intended purpose. Examples of the fluorine-based (meth)acrylate compound include 2,22-trifluoroethylacrylate, 2,2,2-trifluoroethylmethacrylate, 2,2,3,3-tetrafluoropropylacrylate, 2,2,3,3-tetrafluoropropylmethacrylate, 2,2,3,3,4,4,4-heptafluorobutylacrylate, 2,2,3,4,4,4-heptafluorobutylmethacrylate, 2,2,3,4,4,4-hexafluorobutylacrylate, 2,2,3,4,4,4-hexafluorobutylmethacrylate, 1,1,1,3,3,3-hexafluoroisopropylacrylate, 1,1,1,3,3,3-hexafluoroisopropylmethacrylate 1H,1H,5H-octafluoropentylacrylate, 1H, 1H,5H-octafluoropentylmethacrylate 2,2,3,3,3-pentafluoropropylacrylate, 2,2,3,3,3-pentafluoropropylmethacrylate, 2,2,3,3,4,4,5,5,6,6,7,7-dodecafluoroheptylacrylate, 3,3,4,4,5,5,6,7,7,8,8,8-tridecafluorooctylacrylate, 3,3,4,4,5,5,6,6,7,7,8,8,8-tridecafluorooctylmethacrylate, 2-[(1',1',1'-trifluoro-2'-(trifluoromethyl)-2'-hydroxy)propyl]-3-norbornylmethacrylate, 1,1,1-trifluoro-2-(trifluoromethyl)-2-hydroxy-4-methyl-5-pentylmethacrylate, 3,3,4,4,5,5,6,6,7,7,8,8,9,9,10,10,10-heptadecafluorodecylacrylate, 3,3,4,4,5,5,6,6,7,7,8,8,9,9,10,10,10-heptadecafluorodecylmethacrylate, 3,3,4,4,5,5,6,6,7,7,8,8,9,9,10,10,11,11,12,12,12-henicosafluorododecylacrylate, 3,3,4,4,5,5,6,6,7,8,8,9,9,10,10,11,11,12,12,12-henicosafluorododecylmethacrylate, and (trifluoromethyl) dodecylmethacrylate. The above-listed examples may be used alone or in combination.

As the fluorine-based (meth)acrylate compound, a commercial product can be used. Examples of the commercial product include OPTOOL DAC-HP (available from Daikin Industries, Ltd), MEGAFAC RS-75 (available from DIC Corporation), and VISCOAT V-3F (available from Osaka Organic Chemical Industry Ltd.).

An amount of the fluorine-based (meth)acrylate compound in the curable composition is not particularly limited and may be appropriately selected depending on the intended purpose. The amount is preferably 0.1% by mass or greater but 50% by mass or less based on the solid content.

Other components of the curable composition may be appropriately selected depending on the intended purpose. Examples of the above-mentioned other components include polymerization initiators, polymerization inhibitors, and diluent. The curable composition is preferably free from resin particles or inorganic particles.

The polymerization initiator is not particularly limited and may be appropriately selected depending on the intended purpose so long as the polymerization initiator initiates polymerization by light, heat, or the like. However, preferable are a photoradical polymerization initiator and a photo cationic polymerization initiator that produce active species such as radicals and cations by photo energy to initiate polymerization. A photoradical polymerization initiator is more preferable.

Examples of the photoradical polymerization initiator include aromatic ketones, acyl phosphine oxide compounds, aromatic onium salt compounds, organic peroxides, thio compounds (e.g., thioxanthone compounds and thiophenol-group-containing compounds), hexaaryl biimidazole compounds, keto oxime ester compounds, borate compounds, azinium compounds, methallocene compounds, active ester compounds, compounds containing a carbon-halogen bond and alkyl amine compounds.

The photoradical polymerization initiator is not particularly limited and may be appropriately selected depending on the intended purpose. Examples of the photoradical polymerization initiator include acetophenone, acetophenone benzyl ketal, 1-hydroxycyclohexyl phenyl ketone, 2,2-dimethoxy-2-phenyl acetophenone, xanthone, fluorenone, benzaldehyde, fluorene, anthraquinone, triphenyl amine, carbazol, 3-methylacetophenone, 4-chlorobenzophenone, 4,4'-dimethoxy benzophenone, benzophenone, Michler's ketone, benzoin propyl ether, benzoin ethyl ether, benzyl dimethyl ketal, 1-(4-isopropylphenyl)-2-hydroxy-2-methyl-propan-1-one, 2-hydroxy-2-methyl-1-phenylpropan-1-one, thioxanthone, diethyl thioxanthone, 2-isopropyl thioxanthone, 2-chloro thioxanthone, 2-methyl-1-[4-(methylthio) phenyl]-2-morpholino-propan-1-one, bis(2,4,6-trimethyl-benzol)-phenyl phosphine oxide, 2,4,6-trimethyl benzoyl-diphenyl-phosphine oxide, 2,4-diethyl thioxanthone, and bis-(2,6-dimethoxy benzoyl)-2,4,4-trimethyl pentyl phosphine oxide. The above-listed examples may be used alone or in combination.

As the photoradical polymerization initiator, a commercial product can be used. Examples of the commercial product include: IRGACURE 651, IRGACURE 184, DAROCUR 1173, IRGACURE 2959, IRGACURE 127, IRGACURE 907, IRGACURE 369, IRGACURE 379, DAROCUR TPO, IRGACURE 819, IRGACURE 784, IRGACURE OXE 01, IRGACURE OXE 02, and IRGACURE 754 (all available from BASF Japan Ltd); Speedcure TPO (available from Lambson Ltd.); KAYACURE DETX-S (available from Nippon Kayaku Co., Ltd.); Lucirin TPO, LR8893, and LR8970 (all available from BASF Japan Ltd.); and EBECRYL, P36 (available from UCB Japan Co., Ltd.). The above-listed examples may be used alone or in combination.

An amount of the polymerization initiator is not particularly limited and may be appropriately selected depending on the intended purpose. The amount is preferably 1% by mass or greater but 20% by mass or less relative to the curable composition.

In a case where a thick film is formed as in the present disclosure, the photopolymerization initiator is preferably a photopolymerization initiator having excellent inner curing properties and a photobleaching effect, and is more preferably used in combination with a photopolymerization initiator having excellent surface curing properties. The amount of the photopolymerization initiator is more preferably 1% by mass or greater but 10% by mass or less relative to the curable composition.

The polymerization inhibitor is not particularly limited and may be appropriately selected depending on the intended purpose. Examples of the polymerization initiator include: phenol compounds, such as p-methoxyphenol, cresol, t-butylcatechol, di-t-butylparacresol, hydroquinone monomethyl ether, α-naphthol, 3,5-di-t-butyl-4-hydroxy-toluene, 2,2'-methylenebis(4-methyl-6-t-butylphenol), 2,2'-methylenebis(4-ethyl-6-butylphenon, and 4,4'-thiobis(3-methyl-6-t-butylphenol); quinone compounds, such as p-benzoquinone, anthoraquinone, naphthoquinone, phenanthraquinone, p-xyloquinone, p-toluqinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-di-butylhydroquinone, mono-t-butylhydroquinone, monomethylhydroquinone, 2,5-di-t-amylhydroquinone; amine compounds, such as phenyl-β-naphthylamine, p-benzylaminophenol, di-β-naphthylparaphenylenediamine dibenzylhydroxyamine, phenylhydroxyamine, and diethylhydroxyamine; nitro compounds, such as dinitrobenzene, trinitrotoluene, and picric acid; oxime compounds, such as quinone dioxime and cyclohexanone oxime; and sulfur compounds such as phenothiazine. The above-listed examples may be used alone or in combination.

The diluent is not particularly limited and may be appropriately selected depending on the intended purpose. Examples of the diluent include: hydrocarbon-based solvents, such as toluene and xylene; ester based solvents, such as ethyl acetate, n-butyl acetate, methyl cellosolve acetate, and propylene glycol monomethyl ether acetate; ketone-based solvent, such as methyl ethyl ketone, methyl isobutyl ketone, diisobutyl ketone, cyclohexanone, and cyclopentanone; ether-based solvents, such as ethylene glycol monomethyl ether, ethylene glycol monoethyl ether, and propylene glycol monomethyl ether; and alcohol-based solvents, such as ethanol, propanol, 1-butanol, isopropyl alcohol, and isobutyl alcohol. The above-listed examples may be used alone or in combination.

The resin having a polyethylene skeleton is typically polyethylene that is a crystalline resin obtained by polymerizing ethylene, and is classified by synthesis conditions, such as a density, a molecular weight, a pressure, and a catalyst. Moreover, properties of the resin having a polyethylene skeleton vary depending on a density, a molecular weight, a molecular weight distribution, and a molecular structure (e.g., a straight chain and a branched chain).

The resin having a polyethylene skeleton is not particularly limited and may be appropriately selected depending on the intended purpose, but the resin is preferably high-density polyethylene or ultra-high molecular weight polyethylene in view of durability and a low friction coefficient.

The cleaning blade 62 of the present embodiment can inhibit curling of the distal-end ridge portion 62*c* of the elastic member to be in contact with a surface of the cleaning-target member, causes legs abrasion of the distal-end ridge portion 62*c* of the elastic member during use of the cleaning blade, and can maintain an excellent cleaning performance over a long period. Therefore, the cleaning blade 62 of the present embodiment can be widely used in various fields. The cleaning blade 62 of the present embodiment is particularly suitable used for a process cartridge and image forming apparatus described below.

(Process Cartridge, Image Forming Apparatus, and Image Forming Method)

A process cartridge of the present, disclosure includes at least an image bearer and a cleaning unit configured to remove a toner remaining on the image bearer, and the cleaning unit includes the cleaning blade of the present disclosure. The image bearer may be provided with, as a cleaning aid, a system to coat the latent image bearer surface with a lubricant.

The image forming apparatus of the present disclosure includes an image bearer, a charging unit configured to charge a surface of the image bearer, an exposure unit configured to expose the image bearer charged to form an electrostatic latent image, a developing unit configured to develop the electrostatic latent image with a toner to form a visible image, a transfer unit configured to transfer the visible image to a recording medium, a fixing unit configured to fix a transfer image transferred to the recording medium, and a cleaning unit configured to remove the toner remaining on the image bearer, wherein the cleaning unit includes the cleaning blade of the present disclosure. The image bearer may be provided with, as a cleaning aid, a system to coat the latent image bearer surface with a lubricant.

The image forming method of the present disclosure includes at least, charging a surface of an image bearer, exposing the image bearer charged to form an electrostatic latent image, developing the electrostatic latent image with a toner to forth a visible image, transferring the visible image to a recording medium, fixing a transfer image transferred to the recording medium, and removing the toner remaining on the image bearer, wherein the removing is performed with the cleaning blade of the present disclosure.

Next, as one embodiment of an electrophotographic printer, which is the image forming apparatus in which the present disclosure is applied, is explained. Hereinafter, this electrophotographic printer is referred to simply as a printer 500 and this embodiment is referred to as an embodiment. First, the basic configuration of the printer 500 according to the embodiment is explained.

Figure 5:
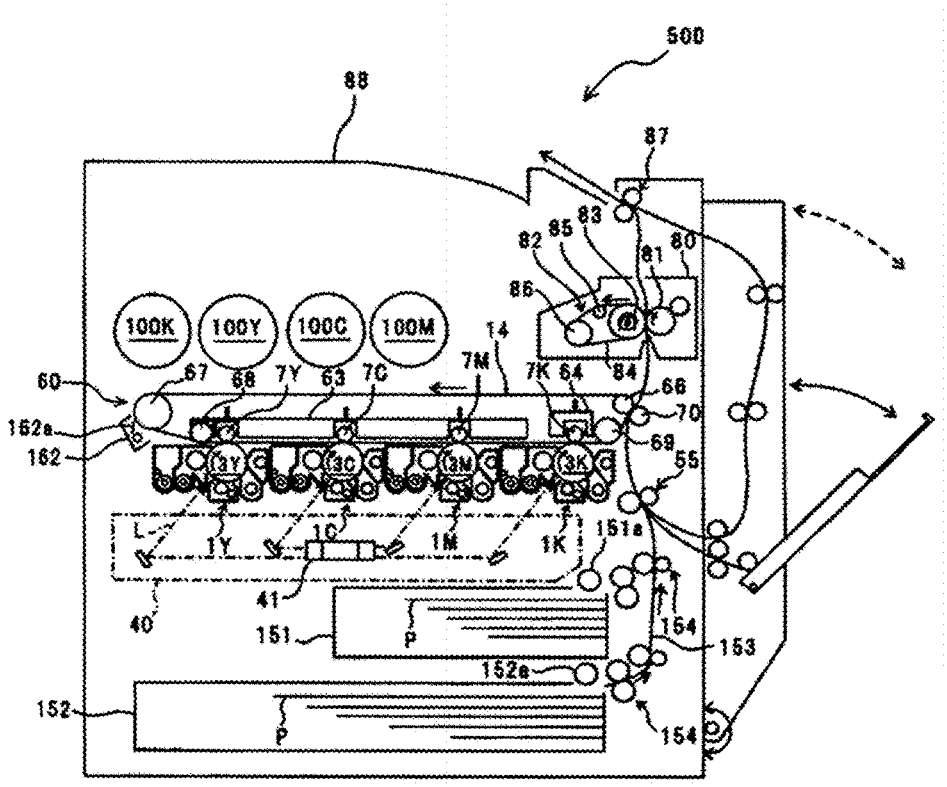
FIG. 5 is a schematic view illustrating one example of an image forming apparatus according to the present disclosure.

FIG. 5 is a schematic view illustrating the printer 500. The printer 500 is equipped with four image formation units for yellow, magenta, can, and black (hereinafter referred to as Y, C, M, and K, respectively) and these four image formation units are denoted by 1Y, 1C, 1M, 1K. The image formation units 1Y, 1C, 1M, 1K have the same structure, provided that the image formation units use toners of different colors; i.e., Y, C, M, and K toners.

A transfer unit 80 equipped with an intermediate transfer belt 14 serving as an intermediate transfer member is provided at the upper side of the four image formation units 1Y, 1C, 1M, 1K. Toner images of the aforementioned colors formed on surfaces of photoconductors 3Y, 3C, 3M, 3K contained in the image formation units 1Y, 1C, 1M, 1K, details of which is described below, are transferred and superimposed on a surface of the intermediate transfer belt 14.

Moreover, a light, writing unit 40 is provided at the bottom side of the image formation units 1Y, 1C, 1M, 1K. The light writing unit 40, serving as a latent image forming unit, is configured to irradiate the photoconductors 3Y, 3C, 3M, 3K in the image formation units 1Y, 1C, 1M, 1K with laser light L based on image information. As a result of the irradiation, electrostatic latent images for Y, C, M, and K are formed on the photoconductors 3Y, 3C, 3M, 3K. The light writing unit 40 is configured to apply the laser light L emitted from a light source to the photoconductors 3Y, 3C, 3M, 3K through a plurality of optical lenses or mirrors, while polarizing the light with a polygon mirror 41 that is rotationally driven by a motor. Instead of such a configuration, it may be possible to employ another configuration in which light scanning is performed with an LED array.

At the bottom of the light writing unit 40, a first paper feeding cassette 151 and a second paper feeding cassette 152 are provided in a manner that they are overlapped in the vertical direction. In each of these paper feeding cassettes, sheets of recording paper P serving as a recording medium are housed in the state of a paper bundle where a plurality of paper sheets are stacked. The recording paper P placed on, the top in each cassette is in contact with a first paper feeding roller 151*a* and a second paper feeding roller 152*a*, respectively. Once the first paper feeding roller 151*a* is rotationally driven in the anticlockwise direction of the drawing by a driving unit, the recording paper P placed on the top in the first paper feeding cassette 151 is discharged to a paper feeding path 153 provided in the vertical direction at the right side of the cassette in the drawing. Once the second paper feeding roller 152*a* is rotationally driven in the anticlockwise direction in FIG. 5 by a driving unit, the recording paper P placed on the top in the second paper feeding cassette 152 is discharged to the paper feeding path 153.

A plurality of pairs of convey rollers 154 are provided in the paper feeding path 153. The recording paper P sent to the paper feeding path 153 is conveyed from the bottom to the top within the paper feeding path 153 in FIG. 5 with being nipped with the pairs of the convey rollers 154.

A pair of registration rollers 55 is provided at the downstream end part of the paper feeding path 153 relative to the traveling direction of the recording paper P. Once the pair of the registration rollers 55 nips therebetween the recording paper P transported from the pair of the convey rollers 154, the rotation of the pair of the convey rollers 154 is stopped temporarily. Then, the recording paper P is sent to the below-mentioned secondary transfer nip at an appropriate timing.

Figure 6:
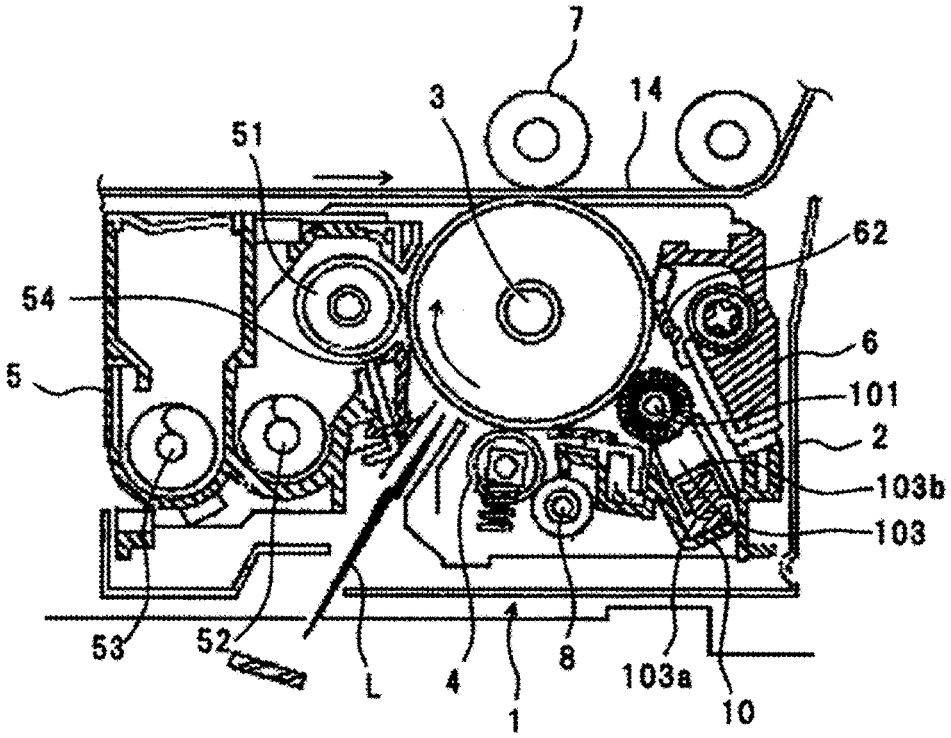
FIG. 6 is a schematic view illustrating one example of an image formation unit mounted in an image forming apparatus according to the present disclosure.

FIG. 6 is a schematic view illustrating the configuration of one of the four image formation units 1.

As illustrated in FIG. 6, the image formation unit 1 is equipped with a drum-shaped photoconductor 3 serving as the image bearer. Although the photoconductor 3 has a drum shape, the photoconductor 3 may be a sheet-type photoconductor or an endless belt-type photoconductor.

In the surrounding area of the photoconductor 3, a charging roller 4, a developing device 5, a primary transfer roller 7, a cleaning device 6, a lubricant coating device 10, a charge neutralization lamp, etc. are provided. The charging roller 4 is a charging member equipped in a charging device serving as a charging unit. The developing device 5 is a developing unit configured to develop a latent image formed on a surface of the photoconductor 3 with a toner to form a toner image. The primary transfer roller 7 is a primary transfer member equipped in a primary transfer device serving as a primary transfer unit, which is configured to transfer the toner image formed on the surface of the photoconductor 3 to an intermediate transfer belt 14. The cleaning device 6 is a cleaning unit configured to remove the toner remaining on the surface of the photoconductor 3, from which the toner image has been transferred to the intermediate transfer belt 14. The lubricant coating device 10 is a lubricant coating unit configured to coat a lubricant onto the surface the photoconductor 3 after the cleaning by the cleaning device 6. The charge neutralization lamp is a charge neutralization unit configured to neutralize the surface potential of the photoconductor 3 after the cleaning. The reference numeral 8 in FIG. 6 denotes a cleaning roller.

The charging roller 4 is provided in a non-contact manner, with a certain space to the photoconductor 3, and is configured to charge the photoconductor 3 with the predetermined polarity and predetermined potential. The laser light L is emitted from the light writing unit 40 to a surface of the photoconductor 3, which has been uniformly charged by the charging roller 4, based on image information, to thereby form an electrostatic latent image.

The developing device 5 contains a developing roller 51 serving as a developer bearer. To the developing roller 51, developing bias is applied from a power source. In a casing of the developing device 5, provided are a supply screw 52 and a stirring screw 53, which are configured to stir a developer housed in the casing, white transporting in the mutually different directions. Moreover, also provided is a doctor 54 configured to regulate the developer held on the developing roller 51. The toner in the developer stirred and transported by two screws of the supply screw 52 and the stirring screw 53 is charged to the predetermined polarity. The developer is then scooped on a surface of the developing roller 51, the scooped developer is regulated by the doctor 54, and the toner is deposited on a latent image on the photoconductor 3 in a developing region facing the photoconductor 3.

The cleaning device 6 contains, for example, a fur brush 101 and a cleaning blade 62. The cleaning blade 62 is brought into contact with the photoconductor 3 in a counter direction to the travelling direction of the surface of the photoconductor 3. Note that, the cleaning blade 62 is the cleaning blade of the present disclosure. The lubricant coating device 10 is equipped with, for example, a solid lubricant 103 and a lubricant press spring 103*a*, and is further equipped with a fur brush 101 as a coating brush configured to coat the solid lubricant 103 on the photoconductor 3. The solid lubricant 103 is held by a bracket 103*b*, and is pressed to the side of the fur brush 101 by the lubricant press spring 103*a*. Then, the solid lubricant 103 is scraped with the fur brush 101, which rotates in the dragging direction relative to the rotational direction of the photoconductor 3, and the scraped lubricant is coated to the surface of the photoconductor 3. By coating the lubricant to the photoconductor, the friction coefficient of the surface of the photoconductor 3 is preferably maintained to 0.2 or less, when an image is not formed.

The charging device in the embodiment is that of a non-contact adjacent setting type, where the charging roller 4 is provided adjacent to the photoconductor 3. However, the charging device may be a known one such as corotron, scorotron, or a solid state charger. Among these charging types, especially, a contact type or a non-contact adjacent setting type is desired. These types have advantages such as high charging efficiency with a small amount of ozone generated, and being possible to downsize the device.

A light source of laser light L of the light vomiting unit 40, and a light source of the charge neutralization lamp may be all kinds of light emitters such as a fluorescent lamp, a tungsten lamp, a halogen lamp, a mercury lamp, a sodium lamp, a light-emitting diode (LED) a laser diode (LD), and an electroluminescent (EL) lamp.

In order to apply only light having the desired wavelength range, it may be possible to use various kinds of filters such as a sharp-cut filter, a band-pass filter, a near infrared-cut filter, a dichroic filter, an interference filter, and a color temperature conversion filter.

Among them, preferred are a light-emitting diode and a laser diode, because they can apply light having a long wavelength of 600 nm to 800 nm.

The transfer unit 60, serving as the above transfer unit, is equipped with, for example, an intermediate transfer belt 14, a belt-cleaning unit 162, a first bracket. 63, and a second bracket 64. Moreover, the transfer unit 60 is further equipped with, for example, four primary transfer rollers 7Y, 7C 7M, 7K, a secondary transfer back-up roller 66, a driving roller 67, a support 68, and a tension roller 69. The intermediate transfer belt 14 is endlessly rotated in the anticlockwise direction in the drawing by the rotational driving of the driving roller while supported by these eight roller members. The four primary transfer rollers 7Y, 7C, 7M, 7K nip the intermediate transfer belt 14 with the photoconductors 3Y, 3C, 3M, 3K, respectively, to thereby form primary transfer nips. Then, a transfer bias having an opposite polarity (e.g., plus) to that of the toner is applied to the back surface of the intermediate transfer belt 14 (the internal perimeter surface of the loop). In the process that the intermediate transfer belt 14 successively passes through the primary transfer nips for Y, C, M, and K in accordance with the endless movement, Y, C, M, and K toner images formed on the photoconductors 3Y, 3C, 3M, 3K are superimposed on the surface of the intermediate transfer belt 14 (the outer perimeter surface of the loop) to thereby perform primary transfer. As a result, a four-color-superimposed toner image (hereinafter referred to as a four-color toner image) is formed on the intermediate transfer belt 14.

The secondary transfer back-up roller 68 nips the intermediate transfer belt 14 with the secondary transfer roller 70 provided at the outer side of the loop of the intermediate transfer belt 14, to thereby form a secondary transfer nip. The aforementioned pair of registration rollers 55 sends the recording paper P, which has been nipped between the rollers, to the secondary transfer nip at timing to synchronize to the four-color toner image formed on the intermediate transfer belt 14. The four-color toner image formed on the intermediate transfer belt 14 is secondary transferred to the recording paper P in the secondary transfer nip by influences of a secondary transfer electric field formed between the secondary transfer roller 70 and the secondary transfer back-up roller 66, to which secondary transfer bias is applied, or nip pressure. As a result, a full-color toner image is formed with the white color of the recording paper.

The toner, which has not been transferred to the recording paper P, is deposited on the intermediate transfer belt 14, which has passed through the secondary transfer nip. Therefore, the intermediate transfer belt 14 is cleaned by a belt-cleaning unit 162. Note that, the belt-cleaning unit 162 contains a belt cleaning blade 162*a* that is brought into contact with the surface of the intermediate transfer belt 14 (the outer perimeter surface of the loop) to scrape and remove the toner remaining on the intermediate transfer belt 14.

The first bracket 63 in the transfer unit 60 is rocked at the predetermined rotational angle by on-off driving of a solenoid with the rotational axis of the support roller 68 being a center. In the case where the printer 500 forms a monochromic image, the first bracket 63 is rotated only a little in the anticlockwise direction in the drawing by the driving of the solenoid. Specifically, the intermediate transfer belt 14 is separated from the photoconductors 3Y, 3C, 3M for Y, C, and M by rotating the primary transfer rollers 7Y, 7C, 7M in the anticlockwise, direction in the drawing with the rotational axis of the support roller 68 being a center. Then, a monochromic image is formed by driving only the image formation unit 1K for K among the four image formation units 1Y, 1C, 1M, 1K. As a result, it is possible to avoid consumptions of the constituting members of the image formation units for Y, C, and M, which will be caused by unnecessarily driving them when a monochromic image is formed.

The fixing unit 80 is provided at the upper side of the secondary transfer nip in the drawing. The fixing unit 80 is equipped with a press heat roller 81, which includes therein a heat source such as a halogen lamp, and a fixing belt unit 82. The fixing belt unit 82 includes a fixing belt 84, a heat roller 83, which includes therein a heat source such as a halogen lamp, a tension roller 85, a driving roller 86, and a temperature sensor. The fixing belt 84 that is endless travels in the anticlockwise direction in the drawing, with supported by the heat roller 83, the tension roller 85, and the driving roller 86. In the process of the endless movement, the fixing belt 84 is heated from the side of the back surface (the internal perimeter surface of the loop) by the heat roller 83. The press heat roller 81, which is rotationally driven in the clockwise direction in the drawing, is brought into contact with the surface of the fixing belt 84 (the outer perimeter surface of the loop) at the position where, the fixing belt 84, which is heated in the above-described manner, is supported by the heat roller 83. As a result, a fixing nip, at which the press heat roller 81 and the thing belt 84 are brought into contact with each other, is formed.

The temperature sensor is provided at the outer side of the loop of the fixing belt 84 in the manner that, the temperature sensor faces the surface of the fixing belt 84 (the outer perimeter surface of the loop) with the predetermined space, and the temperature sensor detects the surface temperature of the fixing belt 84 just before entering the fixing nip. The detected result is sent to the fixing power source circuit. The fixing power source circuit controls, with on-off, a heat source included in the heat roller 83, or a heat source included in the press heat roller 81, based on the detected result of the temperature sensor.

The recording paper P passed through the aforementioned secondary transfer nip is separated from the intermediate transfer belt 14, followed by sending into the fixing unit 80. The recording paper P is then nipped at the fixing nip in the fixing unit 80 to be transported from the bottom side to the upper side in the drawing. In this process, the recording paper P is heated and pressed by the fixing belt 84, to thereby fix the full-color toner image on the recording paper P.

The recording paper P, on which the toner image has been fixed in this manner, is passed through a pair of paper ejection rollers 87, and is then discharged outside the apparatus. A stacking unit 88 is formed on the top surface of the housing of the main body of the printer 500. The recording paper P discharged outside the apparatus by the pair of the paper ejection roller 87 is sequentially stacked in the stacking unit 88.

Toner cartridges 100Y, 100C, 100M, 100K, configured to house the Y, C, M, and K toners therein, are provided above the transfer unit 60. The Y, C, M, and K toners in the toner cartridges 100Y, 100C, 100M, 100K are appropriately supplied to the developing devices in the image formation units 1Y, 1C, 1M, 1K. The toner cartridges 100Y, 100C, 100M, 100K are mounted independently of the image formation units 1Y, 1C, 1M, 1K, and can be detachably mounted in the main body of the printer.

Next, image forming operations performed in the printer 500 are explained.

Once a signal for a print execution from an operation unit is received, the predetermined voltage or electric current is applied to the charging roller 4 and the developing roller 51 successively at the predetermined timings. Similarly the predetermined voltage or electric current is applied to a light source of the light writing unit 40 and a light source such as the charge neutralization lamp successively at the predetermined timings. In the synchronized motions to this, the photoconductor 3 is rotationally driven in the direction shown with the arrow in the drawing by a photoconductor driving motor serving as a driving unit.

Once the photoconductor 3 is rotated in the direction shown with the arrow in the drawing, first, a surface of the photoconductor 3 is uniformly charged to the predetermined potential by the charging roller 4. Then, laser light L is applied to the surface of the photoconductor 3 from the light writing unit 40 corresponding to the image information. As a result, the charges in an area of the surface of the photoconductor 3, where the laser light L is applied, are eliminated, to thereby form an electrostatic latent image.

The surface of the photoconductor 3, on which the electrostatic latent image has been formed, is rubbed by a magnetic brush, which is composed of a developer and formed on the developing roller 51, in the region facing the developing device 5. In this operation, the negatively charged toner on the developing roller 51 is transported to the side of the electrostatic latent image by the predetermined developing bias applied to the developing roller 51, to thereby form a toner image (development). The similar image formation process is performed in the image formation units 1Y, 1C, 1M, 1K, and the toner images of respective colors are formed on the surfaces of the photoconductors 3Y, 3C, 3M, 3K.

As mentioned above, the electrostatic latent image formed on the photoconductor 3 is reversely developed with the negatively charged toner by the developing device 5 in the printer 500. In the embodiment, an NIP (negative-positive: a toner is deposited on an area having the lower potential) non-contact charging roller system is explained above, but a system for use is not limited to the aforementioned system.

The toner images of respective colors formed on the surfaces of the photoconductors 3Y, 3C, 3M, 3K are sequentially primary transferred so that they are superimposed on a surface of the intermediate transfer belt 14. As a result, the four-color toner image is formed on the intermediate transfer belt 14.

The four-color toner image formed on the intermediate transfer belt 14 is transferred to recording paper P, which is fed from the first paper feeding cassette 151 or the second paper feeding cassette 152, and is fed to the secondary transfer nip with going through between the pair of the registration rollers 55. During this operation, the recording paper P is temporarily stopped with being nipped between the pair of the registration rollers 55, is synchronized with the edge of the image on the intermediate transfer belt 14, and is supplied to the secondary transfer nip. The recording paper P, to which the toner image has been transferred, is separated from the intermediate transfer belt 14, and is sent to the fixing unit 80. As the recording paper P, to which the toner image has been transferred, passes through the fixing unit 80, the toner image is fixed on the recording paper P by heat and pressure. The recording paper P to which the toner image has been fixed, is discharged outside the printer 500 and is stacked the stacking unit 88.

Meanwhile, the toner remaining on the surface of the intermediate transfer belt 14, from which the toner image has been transferred to the recording paper P at the secondary transfer nip, is removed by the belt-cleaning unit 162.

Moreover, the toner remaining on the surface of the photoconductor 3, from which the toner image has been transferred to the intermediate transfer belt 14 at the primary transfer nip, is removed by the cleaning device 6. Thereafter, a lubricant is applied to the surface of the photoconductor 3 by the lubricant coating device 10, followed by discharging the surface thereof by the charge neutralization lamp.

As illustrated in FIG. 6, the image formation unit 1 in the printer 500 is composed of the photoconductor 3, and as process units, the charging roller 4, the developing device 5 the cleaning device 6 and the lubricant coating device 10, all of which are housed in a frame body 2. The image formation unit 1 is detachably mounted, as a process cartridge, in the main body of the printer 500. In the printer 500, the image formation unit 1 has a configuration that the photoconductor 3 and the process units are integrally replaced as a process cartridge. However, a configuration for use may be a configuration where the photoconductor 3, the charging roller 4, the developing device 5, the cleaning device 6, and the lubricant coating device 10 are individually replaced per unit.

Next, a toner suitable for a printer applied in the present disclosure will be described.

As a toner used for the printer 500, a polymerization toner produced by a suspension polymerization method, an emulsion polymerization method, or a dispersion polymerization method, with all of which high circularity of particles and a small particle size are easily achieved, is preferably used in order to improve image quality. Particularly, a polymerization toner having a circularity of 0.97 or greater and a volume average particle diameter of 5.5 μm or less is preferably used. Since the polymerization toner having the average circularity of 0.97 or greater and the volume average particle diameter of 5.5 μm or less is used, images of higher resolution can be formed.

Figure 7A:
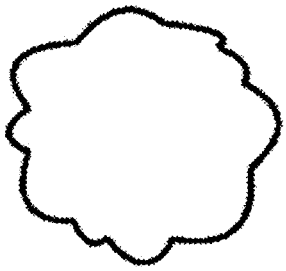
FIG. 7A is a view describing a measuring method of circularity of a toner (part 1)
Figure 7B:
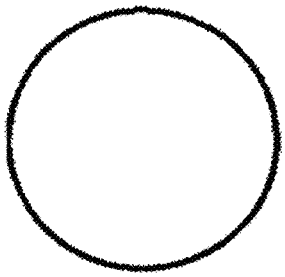
FIG. 7B is a view describing the measuring method of the circularity of the toner (part 2)

In the present specification, the term "circularity" means an average circularity measured by a flow particle image analyzer FPIA-2000 (available from Sysmex Corporation). A specific measuring method of the average circularity is as follows. As a dispersant, 0.1 mL through 0.5 mL of a surfactant, preferably alkyl benzene sulfonic acid salt, is added to 100 mL through 150 mL of water from which impurity solids have been removed in advance in a container, followed by further adding about 0.1 g through about 0.5 g of a measurement sample. The suspension liquid, in which the sample has been dispersed, is subjected to a dispersion treatment for about 1 minute through about 3 minutes by an ultrasonic disperser to adjust a concentration of the dispersion liquid to from 3,000 particles/μL through 10,000 particles/μL. Shapes of particles of the toner and size distribution of the particles of the toner can be measured from the dispersion liquid by means of the above-mentioned device. Based on the measurement results, a length of circumference of an actual projected toner shape illustrated in FIG. 7A is determined as C1, the projected area (projected particle area is determined as S, length of circumference (perimeter) of a perfect circle illustrated in FIG. 7B and having the same area to the projected area S is determined as C2, and a value of C2/C1 is determined. An average value of the calculated values of C2/C1 is determined as a circularity.

The volume average particle diameter can be determined by the Coulter Counter method. Specifically, data of a number distribution or volume distribution of a toner measured by Coulter Multisizer 2e (available from Beckman Coulter Inc.) is sent to a personal computer via an interface (available from Nikkaki) and is then analyzed.

Specific example of the analysis method will be explained. A 1% by mass NaCl aqueous solution prepared by using grade-1 sodium chloride is provided as an electrolyte. As a dispersant, 0.1 mL through 5 mL, of a surfactant, preferably alkyl benzene sulfonic acid salt, is added to 100 mL through 150 mL of the electrolyte aqueous solution. To the resultant mixture, 2 mg through 20 mg of the toner as a measurement sample is added. The resultant is subjected to a dispersion treatment for about 1 minute through about 3 minutes by an ultrasonic disperser.

Another beaker is charged with 100 mL through 200 mL of an electrolyte aqueous solution, and the solution which has been subjected to the dispersion treatment is added to the electrolyte aqueous solution in the beaker to give the predetermined concentration. The resultant is provided to Coulter Multisizer 2e above.

As an aperture, the aperture of 100 μm is used, and particle diameters of 50,000 toner particles are measured.

As for channels, the following 13 channels are used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm and 32.00 μm or larger, but smaller than 40.30 μm. The target particles for the measurement are particles having the diameters of 2.00 μm or larger, but smaller than 32.0 μm.

Then, the volume average particle diameter is calculated based on a relational expression of "volume average particle diameter=$\Sigma XfV/\Sigma fV$." Note that, "X" is a representative diameter of each channel, "V" is a relative volume with the representative diameter of each channel, and "f" is the number of particles in each channel.

At the time of use of the above-described polymerization toner, even when the polymerization toner is attempted to be removed from a surface of the photoconductor 3 with the cleaning blade 62 in the same manner as when a pulverized toner in the art is removed, the polymerization toner cannot be sufficiently removed from the surface of the photoconductor 3 and a cleaning failure occurs. Moreover, a recent low-temperature-fixing toner using a crystalline resin significantly deforms when the toner passes through the blade. As a result, the toner may adhere to a ridge line of the blade or may be fused onto a surface of the photoconductor. When contact pressure of the cleaning blade 62 against the photoconductor 3 is increased to increase a cleaning performance in order to solve the above-described problems, there is a problem that the cleaning blade 62 is abraded quickly.

Moreover, a friction force between the cleaning blade 62 and the photoconductor 3 is increased. As a result, the distal-end ridge portion of the cleaning blade 62 in contact with the photoconductor 3 is pulled towards a traveling direction of the photoconductor 3 and the distal-end ridge portion is curled up. When the distal-end ridge portion of the cleaning blade 62 is curled up, various problems, such as noise, vibrations, and breaking-off of the distal-end ridge portion, are caused.

The cleaning blade of the present disclosure does not cause a cleaning failure when the above-described polymerization toner is used in combination, and does not cause noise, vibrations, breaking-off of the distal-end ridge portion, etc.

EXAMPLES

The present disclosure will be described an more detail by way of the following Examples. However, the present disclosure should not be construed as being limited to these Examples.

Examples and Comparative Examples below were evaluated by varying a base of an elastic member, a material (a curable composition) for forming a surface layer, a film thickness of the surface layer of a contact part, and a formation region of the surface layer.

As a base of an elastic member, 6 kinds of urethane rubber (Bases 1 to 6) each having JIS-A hardness, rebound resilience at 23° C., and Martens hardness (HM) as presented in Table 1 were prepared. Measuring methods will be described below.

<JIS-A Hardness of Base>

JIS-A hardness of a base of an elastic member at a side of a bottom surface was measured by means of a micro-rubber hardness tester MD-1 available from KOBUNSHI KEIKI CO., LTD. according to JIS K6253 (23° C.).

<Rebound Resilience of Base>

Rebound resilience of a base of an elastic member was measured at 23° C. by means of No. 221 resilience tester available from TOYO SEIKI SEISAKU-SHO, LTD. according to JIS K6255. As a sample, a laminate of sheets each having a thickness of 2 mm was used to give the sample a thickness of 4 mm or greater.

<Martens Hardness of Base>

Martens hardness (HM) of a base of an elastic member was measured on a blade edge surface of the base by means of a is microhardness meter HM-2000 available from Fischer Instruments K.K. by pressing the Vickers indenter into the blade edge surface with a force of 1.0 mN for 10 seconds, retaining for 5 seconds, and pulling out with a force of 1.0 mN for 10 seconds.

Figure 8A:
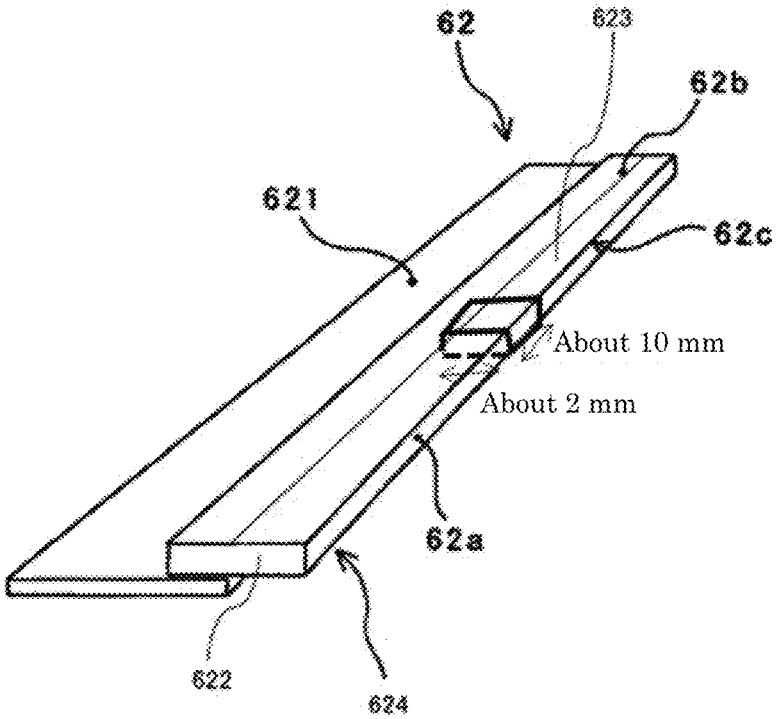
FIG. 8A is a schematic view describing a method for measuring Martens hardness of a base at an edge surface of a blade (part 1)

As a method for measuring the edge surface of the blade, the edge of the blade was cut into a size having a depth of about 2 mm and a width of 100 mm as illustrated in FIG. 8A, the cut piece was fixed on a glass slide etc. with an adhesive or a double-sided tape in a manner that the edge surface faced upwards, and a measurement was performed on a position that was 100 μm away from the distal-end ridge portion of the edge surface.

Figure 8B:
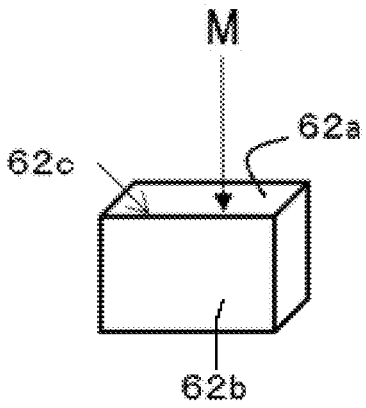
FIG. 8B is a schematic view describing the method for measuring the Martens hardness of the base at the edge surface of the blade (part 2)
Figure 8C:
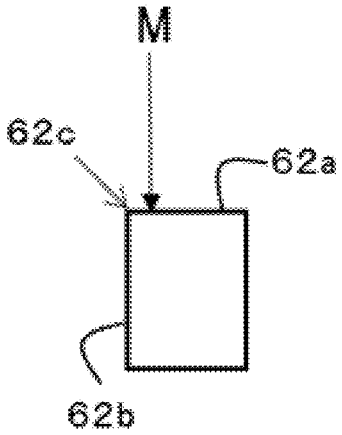
FIG. 8C is a schematic view describing the method for measuring the Martens hardness of the base at the edge surface of the base (part)
Figure 8D:
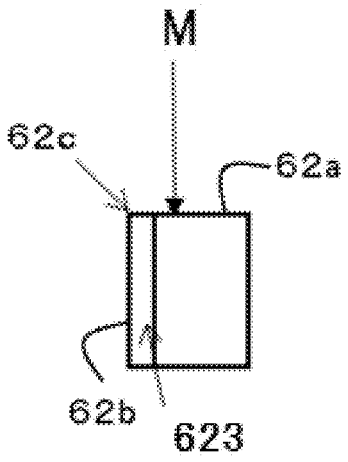
FIG. 8D is a schematic view describing the method for measuring the Martens hardness of the base at the edge surface of the base (part 4)

The detail of the measurement position M is illustrated in FIGS. 8B, 8C, and 8D. FIGS. 8B and 8C illustrate the measurement position M when a surface layer is not disposed on the base, and FIG. 8D illustrates the measurement position M in a state where the surface layer is disposed on the base.

TABLE 1

| No. | Base rubber structure | Rebound resilience at 23° C. [%] | Hardness at 23° C. at contact surface side/JIS-A° | HM [N/mm$^2$] | |
|---|---|---|---|---|---|
| 1 | single layer | 45 | 75 | 0.9 | TOYO CHEMICAL INDUSTRIAL PRODUCTS CO., LTD. |
| 2 | single layer | 18 | 71 | 0.6 | TOYO CHEMICAL INDUSTRIAL PRODUCTS CO., LTD. |
| 3 | single layer | 13 | 89 | 2.0 | TOYO CHEMICAL INDUSTRIAL PRODUCTS CO., LTD. |
| 4 | single layer | 36 | 89 | 3.5 | TOYO CHEMICAL INDUSTRIAL PRODUCTS CO., LTD. |
| 5 | single layer | 20 | 90 | 4.5 | TOYO CHEMICAL INDUSTRIAL PRODUCTS CO., LTD. |
| 6 | single layer | 36 | 76 | 1.0 | TOYO CHEMICAL INDUSTRIAL PRODUCTS CO., LTD. |

<Formation Example of Surface Layer>

Preparation Example

—Preparation of Curable Composition—

Curable Compositions 1 to 9 were prepared with compositions presented in Table 2 below according to a typical method known in the art. Curable Compositions 1 and 2 are heat-curable compositions and Curable Compositions 3 to 9 are ultraviolet ray-curable compositions.

TABLE 2

| No. | Curable material resin ratio [% by mass] | Ratio of polymerization initiator to resin [% by mass] | Solvent | Concentration of solids of resin [% by mass] | |
|---|---|---|---|---|---|
| 1 | Resin 1: EPICLON EXA-4816 [100%] | Curing agent: acid anhydride (MTHPA) [41%] Accelerator: BDMA [1%] | — | — | Thermal curing |
| 2 | Resin 1: SQ100 [100%] | Polymerization initiator: UAX-615 [20%] | Butyl acetate | 48% through 52% | Thermal curing |
| 3 | Resin 1: ODA [40%] Resin 2: EBECRYL140 [60%] | Polymerization initiator: IRGACURE 819 [3%] | Cyclo hexanone | 50% | UV curing |
| 4 | Resin 1: PETIA [79%] Resin 2: DPGDA [20%] Resin 3: OPTOOL [1%] | Polymerization initiator: IRGACURE 819 [5%] | Cyclo hexanone | 50% | UV curing |
| 5 | Resin 1: ODA [40%] Resin 2: EBECRYL140 [60%] | Polymerization initiator: IRGACURE 184 [15%] | Cyclo hexanone | 50% | UV curing |
| 6 | Resin 1: EBECRYL140 [100%] | Polymerization initiator: IRGACURE 184 [5%] | Cyclo hexanone | 50% | UV curing |
| 7 | Resin 1: ODA [30%] Resin 2: EBECRYL140 [70%] | Polymerization initiator: IRGACURE 819 [3%] | Cyclo hexanone | 50% | UV curing |
| 8 | Resin 1: PETIA [84%] Resin 2: DPGDA [15%] Resin 3: OPTOOL [1%] | Polymerization initiator: IRGACURE 819 [5%] | Cyclo hexanone | 50% | UV curing |
| 9 | Resin 1: ODA [30%] Resin 2: EBECRYL140 [70%] | Polymerization initiator: IRGACURE 184 [15%] | Cyclo hexanone | 50% | UV curing |

In Table 2, MTHPA denotes 3-methyl-4-cyclohexene-1, 2-dicarboxylic acid anhydride and BDMA denotes N,N-dimethylbenzylamine.

The detail of the curable materials used in Curable Compositions 1 to 9 are presented in Tables 3 and 4 below.

TABLE 3

Figure 15:
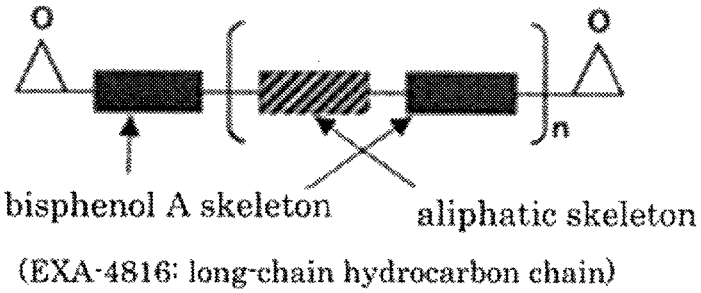
FIG. 15 shows a molecular structure of curable material named EXA-4816, listed in Table 3.
Figure 16:
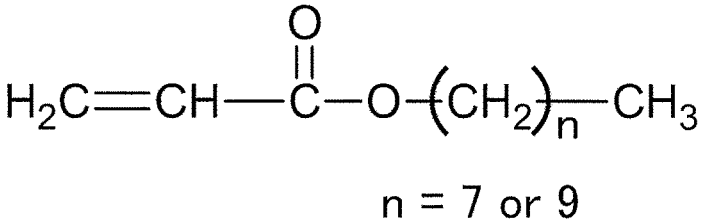
FIG. 16 shows a molecular structure of curable material named ODA, listed in Table 3.
Figure 17:
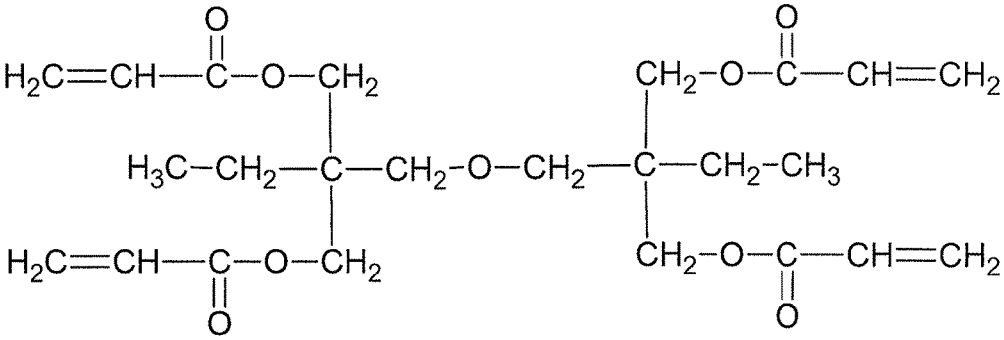
FIG. 17 shows a molecular structure of curable material named EBECRYL140, listed in Table 3.
Figure 18:
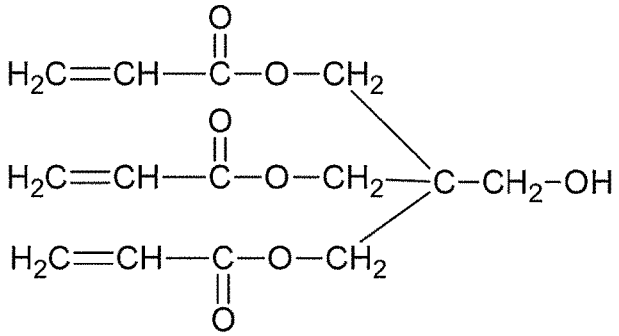
FIG. 18 shows a molecular structure of curable material named PETIA, listed in Table 3.
Figure 19:
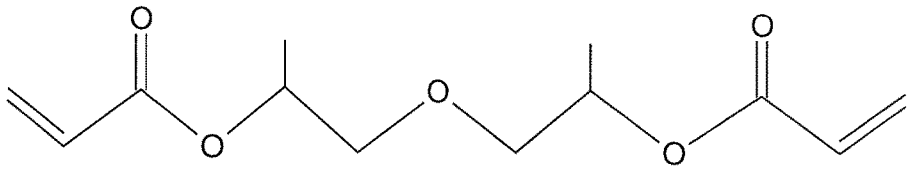
FIG. 19 shows a molecular structure of curable material named DPGDA, listed in Table 3.
Figure 20:
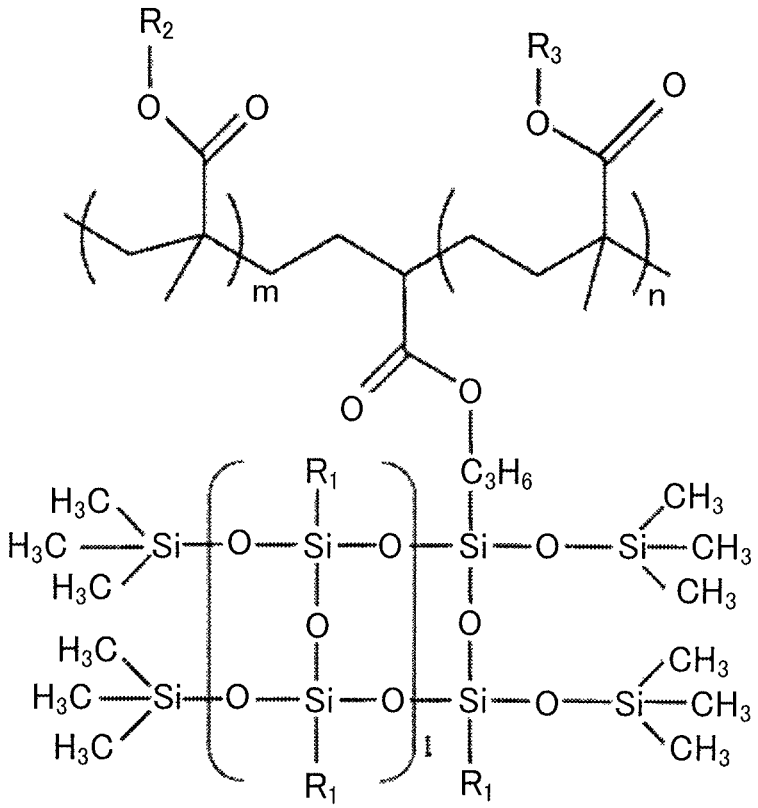
FIG. 20 shows a molecular structure of curable material named SQ 100, listed in Table 3.
Figure 20:
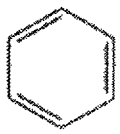

| Curable material | | Molecular structure |
|---|---|---|
| EPICLON EXA-4816 | Highly durable-flexible tough epoxy resin | see FIG. 15 |
| SQ 100 | Silicone-modified acrylic resin | see FIG. 20 |
| ODA | Octyl/decyl-acrylate | see FIG. 16 |
| EBECRYL140 | Ditrimethylol propane tetraacrylate | see FIG. 17 |
| PETIA | Pentaerythritol-triacrylate | see FIG. 18 |
| DPGDA | Dipropylene glycol diacrylate | see FIG. 19 |
| OPTOOL | Fluorine-based acrylate | — |
| DAC-HP | (perfluoropolyether skeleton) | |

SQ100

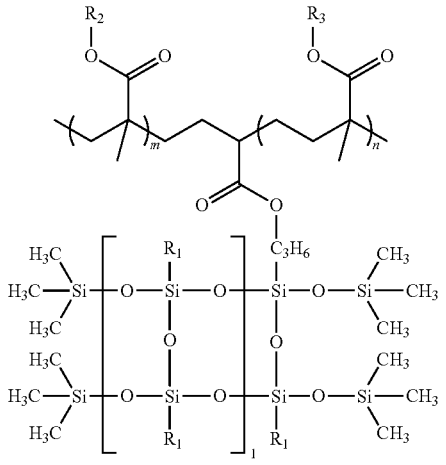

$R_1$: $C_nH_{2n+1}$ or

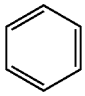

$R_2$: $C_nH_{2n+1}$
$R_3$: $C_nH_{2n}OH$ or H

TABLE 4

| Material | Manufacturer | Number of functional groups | Molecular weight |
|---|---|---|---|
| EPICLON EXA-4816 | DIC Corporation | 2 | — |
| SQ 100 | TOKUSHIKI Co., Ltd. | — | — |
| ODA | DAICEL-ALLNEX LTD. | 1 | 200 |
| EBECRYL140 | DAICEL-ALLNEX LTD. | 4 | 438 |
| PETIA | DAICEL-ALLNEX LTD. | 3 | 298/352 |
| DPGDA | DAICEL-ALLNEX LTD. | 2 | 242 |
| OPTOOL DAC-HP | DAIKIN INDUSTRIES, LTD. | — | — |
| UAX-615 | TOKUSHIKI Co., Ltd. | — | — |
| IRGACURE819 | BASF Japan Ltd. | — | — |
| IRGACURE184 | BASF Japan Ltd. | — | — |

—Cured Product Film of Curable Composition—

Cured product films of curable compositions presented in Table 5 below were used.

TABLE 5

| No. | Type | Manufacturer | Product name | Film thickness |
|---|---|---|---|---|
| 10 | Low-density polyethylene | SANPLATEC CO., LTD. | Polyethylene film sheet, soft | 70 μm |
| 11 | Low-density polyethylene | SANPLATEC CO., LTD. | Polyethylene film sheet, soft | 100 μm |
| 12 | High-density polyethylene | Okura Industrial Co., Ltd. | HD film | 10 μm |
| 13 | High-density polyethylene | Okura Industrial Co., Ltd. | HD film | 50 μm |
| 14 | High-density polyethylene | Okura Industrial Co., Ltd. | HD film | 150 μm |
| 15 | Ultra-high molecular weight polyethylene | Saxin Corporation | Newlight Innovate Film | 30 μm |

<Production Example of Toner>

A toner produced by a polymerization method (Japanese Unexamined Patent Application Publication No. 2014-92633) described below was used.

Physical properties of the produced toner were as follows.

Toner base particles: average circularity of 0.98 and volume average particle diameter of 4.9 μm External additives:

1.5 parts by mass of small particle-size silica (H2000, available from Clariant)

0.5 parts by mass of small particle-size titanium oxide (MT-150AI, available from TAYCA CORPORATION)

1.0 part by mass of large particle-size silica (UFP-30H, available from Denka Company Limited)

Glass transition temperature of toner: 50° C.

Example 1

<Production of Cleaning Blade 1>

A bottom surface of Base 1 having a thickness of 1.8 mm in a strip shape was masked with leaving a 4 mm width from an edge surface of Base 1, and Curable Composition 1 was applied onto the bottom surface of Base 1 is a manner that a surface layer having an average film thickness of 25 μm was to be formed.

Specifically, Curable Composition 1 was applied multiple times onto an entire area of the bottom surface of Base 1 from the edge surface of the base by spray coating at a spray-gun traveling-speed of 6 mm/s. Thereafter, the masking was removed, and the resultant was heated for 3 hours in a thermostat of 110° C., followed by heating for 2 hours in a thermostat of 165° C. to cure Curable Composition 1.

Next, the resultant was cut at a position that was 1 mm from the edge surface to form a contact part.

Next, each elastic member at the contact part of which the surface layer was formed was fixed onto a metal plate holder (supporting member) with an adhesive, in order to mount the elastic member on a color multifunction peripheral (IMAGIO MP C4500, available from Ricoh Company Limited). In the manner as described, Cleaning Blade 1 at the contact part of which the surface layer was formed was produced.

Various properties of the produced elastic member and cleaning blade were measured in the following manner. The results are presented in Table 6.

<Average Thickness of Surface Layer>

Figure 9:
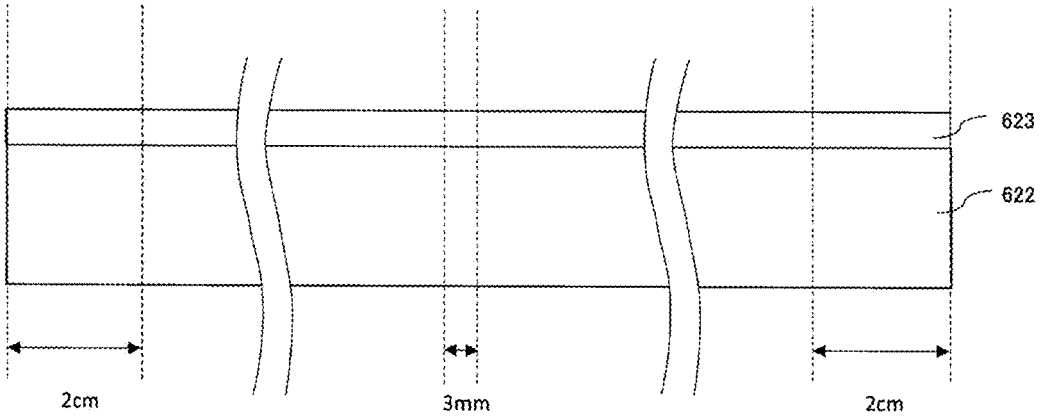
FIG. 9 is a view for describing one example of a measuring method of an average film thickness of a surface layer.

FIG. 9 is a cross-sectional view illustrating a measurement site of a thickness of the contact part of the cleaning blade in Examples.

As illustrated in FIG. 9, the elastic member was sliced along a surface orthogonal to a longitudinal direction of the elastic member and the resultant cross-sectional surface was arranged upwards and observed under a digital microscope VHX-2000 (available from KEYENCE CORPORATION). The measurement site was a position of the cross-section 5 μm away from the blade contact part (distal-end ridge portion) of the cross-section.

As a method for slicing the elastic member, the elastic member was cut using a razor vertically placing relative to the longitudinal direction of the elastic member in a manner that a thickness of the elastic member along the longitudinal direction was to be 3 mm. At the time of slicing, a cross-section can be cleanly cut out when a vertical slicer is used. A position in the longitudinal direction at which the elastic member was sliced was any position outside portions that were 2 cm from both the edges.

<Radius of Curvature of Contact Part>

Figure 10:
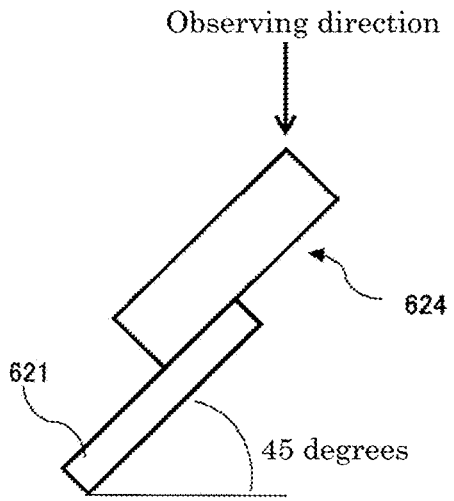
FIG. 10 is a view describing one example of an observation method in a measurement of a radius of curvature.
Figure 11:
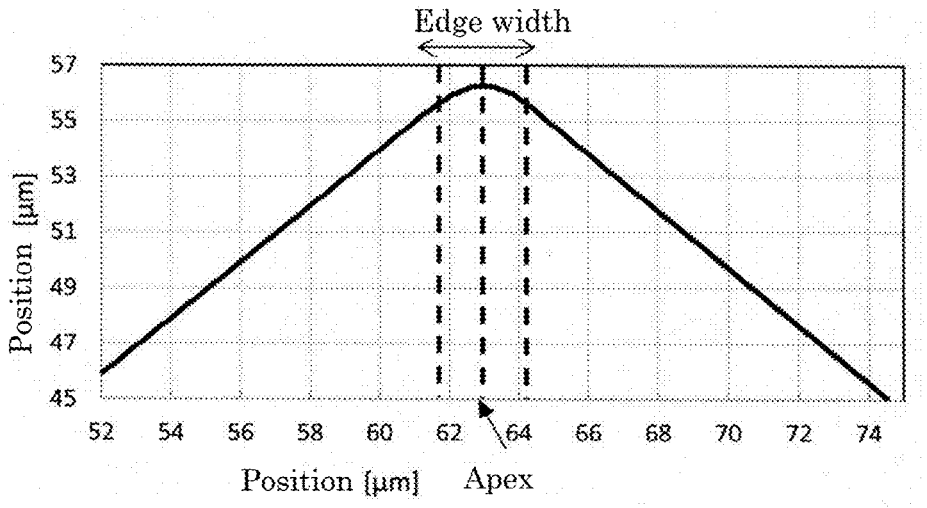
FIG. 11 is a graph describing one example of a result obtained by a measurement of a radius of curvature.

A radius of curvature of the contact part (distal-end ridge portion) of the cleaning blade in Examples was observed by observing the contact part of the cleaning blade under a laser microscope VK-9510 (available from KEYENCE CORPORATION) from a direction of 45 degrees, as illustrated in FIG. 10. One example of the measurement is presented in FIG. 11. The example illustrated in FIG. 11 is an example where a radius of curvature is 2.5 μm, the radius of curvature is determined by using a calculation formula: a radius of curvature=edge width/√2. Note that, the measurement site was any position outside portions that were 2 cm from both the edges.

<Martens Hardness of Cleaning Blade>

In Examples, Martens hardness (HM) of the cleaning blade was measured on a bottom surface of the cleaning blade by means of a microhardness meter HM-2000 available from Fischer Instruments K.K. by pressing the Vickers indenter into the bottom surface with a force of 1.0 mN for 10 seconds, retaining for 5 seconds, and pulling out with a force of 1.0 mN for 10 seconds. The measurement site was set to a position that was 20 μm from the distal-end ridge portion, and the measurement was performed in a manner that the Vickers indenter was in contact with the surface layer. Note that, the measurement site was any position outside portions that were 2 cm from both the edges.

<Assembling of Image Forming Apparatus>

Cleaning Blade 1 produced was mounted in a color multifunction peripheral (IMAGIO MP 04500, available from Ricoh Company Limited) (a printer part had the same structure as the structure of the image forming apparatus 500 illustrated in FIG. 5) to assemble an image forming apparatus of Example 1.

Not that, the cleaning blade was mounted in the image forming apparatus in a manner that a linear pressure was to be 20 g/cm and a cleaning angle was to be 79°. Moreover, the above device was equipped with a lubricant coating device configured to apply a lubricant onto a surface of a photoconductor and as a result of an application of the lubricant, a coefficient of static friction of the surface of the photoconductor was maintained at 0.2 or less when an image was not formed. Note that, a measuring method of the coefficient of static friction of the surface of the photoconductor is the Euler's belt that is disclosed, for example, in the paragraph [0046] of Japanese Unexamined Patent Application Publication No. 00-166919.

<Image Formation Conditions>

By means of the image forming apparatus, 50,000 sheets (A4-size, landscape) were output in a laboratory environment of 21° C. and 65% RH, and feeding conditions that a chart having an image area rate of 5% was printed at 3 prints/job. After outputting the 50,000 sheets, various properties were evaluated in the following manner. The results are presented in Table 7.

<Cleaning Performance>

As an evaluation image, a chart having 3 vertical bands (relative to a traveling direction of the sheet) each having a width of 43 mm was printed on 20 sheets each in a landscape A4 size, and the obtained images were visually observed. The cleaning performance vas evaluated by the presence of an abnormal image due to a cleaning failure. In the criteria below, "A", "B," and "C" were regarded as acceptable and "D" was regarded as unacceptable.

[Evaluation Criteria]

A: The toner passed through due to a cleaning failure could not be visually observed on a print sheet nor the photoconductor, and a linear mark of the toner passed through could not observed when the photoconductor was observed under a microscope along the longitudinal direction.

B: The toner passed through due to a cleaning failure could not be visually observed on a print sheet nor the photoconductor.

C: There was no toner passed through due to a cleaning failure observed on a print sheet but the toner passed through could be visually observed on the photoconductor.

D: The toner passed through due to a cleaning failure could be visually observed both on a print sheet and the photoconductor.

<Noise>

As an evaluation of noise, generation of noise was confirmed by human ears at the time an image output of the evaluation of the cleaning performance, and the noise was judged as follows. At the time of the evaluation, any sound generated from the blade was evaluated as generation of noise without any classification, even when there was a difference in noise such as a high frequency and low frequency.

[Evaluation Criteria]

I: Noise was not generated.

II: Noise was generated.

<Abraded Amount of Contact Part>

Figure 12:
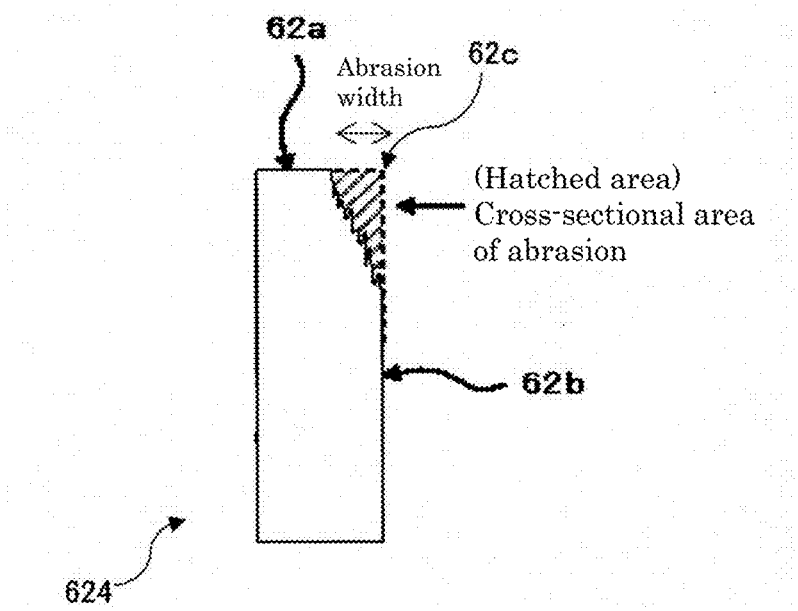
FIG. 12 is a view describing one example of a measurement site of an abrasion width of an elastic member.

After outputting the 50,000 sheets, as an abraded amount of the contact part of the elastic member, an abrasion width observed from the edge surface side of the elastic member was measured by a laser microscope VK-9510 (available from KEYENCE CORPORATION) as illustrated in FIG. 12. When the surface layer was formed, as the abraded amount of the contact part of the elastic member, an abraded amount of the surface layer was measured. When the surface layer was not formed, an abraded amount of the base was measured.

Comparative Example 1

Base 1 was used as Cleaning Blade 27.

Examples 2, 9, 13, 15, 19, and 20, and Comparative Example 2

—Production of Cleaning Blades 2, 9, 13, 15, 19, 20, and 28—

Cleaning Blades 2, 9, 13, 15, 19, 20, and 28 of Examples 2, 9, 13, 15, 19, and 20 and Comparative Example 2 were produced in the same manner as in Example 1, except that the base, the curable composition (the curable material for forming a surface layer), the formation region of the surface layer, and the thickness of the surface layer of Cleaning Blade 1 of Example 1 were changed as presented in Table 6 below.

Example 3, 10, and 14

—Production of Cleaning Blades 3, 10, and 14—

According to the production of Cleaning Blade 1 of Example 1, coating was performed except that the base, the curable composition (the curable material for forming a surface layer), the formation region of the surface layer, and the thickness of the surface layer were changed as presented in Table 6 below. The curing conditions were different from Example 1. After performing pre-drying in a thermostat of 80° C. for 3 minutes, the resultant was heated in a thermostat of 80° C. for 60 minutes to cure the curable composition.

Next, the resultant was cut at the position that was 1 mm from the edge surface to form a contact part.

Examples 4 to 8, 11, 12, and 16 to 18, and Comparative Example 3 and 5

—Production of Cleaning Blades 4 to 8, 11, 12, 16 to 18, 29, and 31—

According to the production of Cleaning Blade 1 of Example 1, coating was performed except that the base, the curable composition (the curable material for forming a surface layer), the formation region of the surface layer, and the thickness of the surface layer were changed as presented in Table 6 below. The curing conditions were different from Example 1. Ultraviolet ray exposure was performed using a high-pressure mercury-vapor lamp in a manner that the accumulated UV irradiation dose was to be 6,000 mJ/cm$^2$. The ultraviolet ray exposure was performed in a nitrogen atmosphere (irradiation atmosphere). Moreover, ultraviolet rays were applied by setting the distal-end ridge portion of the blade facing upwards relative to the high-pressure mercury-vapor lamp disposed at the top. In this manner, ultraviolet rays were efficiently applied to the distal-end ridge portion.

Next, the resultant was cut at a position that was 1 mm from the edge surface, to thereby form a contact part.

<Measurement Method of Accumulated Ultraviolet Light Dose>

An accumulated ultraviolet light dose at a wavelength of 254 mm was measured by means of an ultraviolet action-hour meter UIT-250 (available from USHIO INC.). The measurement was performed by setting a sensor part of the action-hour meter to the same height to the distal-end ridge portion of the cleaning blade.

Comparative Example 4

—Production of Cleaning Blade 30—

A region of a strip-shaped base 2 that was 3 mm from an edge surface, where the base 2 had a thickness of 1.8 mm, was immersed in a is curable composition 3 and then pulled out in a manner that a surface layer having an average film thickness of 1 μm was formed at a contact part, to thereby perform coating. Thereafter, ultraviolet ray exposure was performed using a high-pressure mercury-vapor lamp in a manner that an accumulated UV irradiation dose was to be 6,000 mJ/cm$^2$. The ultraviolet ray exposure was performed in a nitrogen atmosphere (irradiation atmosphere). Moreover, ultraviolet rays were applied by setting the distal-end ridge portion of the blade facing upwards relative to the high-pressure mercury-vapor lamp disposed at the top. In this manner, ultraviolet rays were efficiently applied to the distal-end ridge portion.

Examples 21 to 26 and Comparative Example 6

—Production of Cleaning Blades 21 to 26 and 32—

A flat plate-shaped base having a thickness of 1.8 mm and a size of 23 mm×326 mm was masked and a surface layer was formed on part of a surface of the base with a film of a cured product of a curable composition presented in Table 5 or 6. Thereafter, the resultant was cut at the center to reduce the size in half, to thereby produce a sheet of a strip shape in a size of 11.5 mm×326 mm.

A production process will be described with reference to FIGS. 13A to 13C.

Figure 13A:
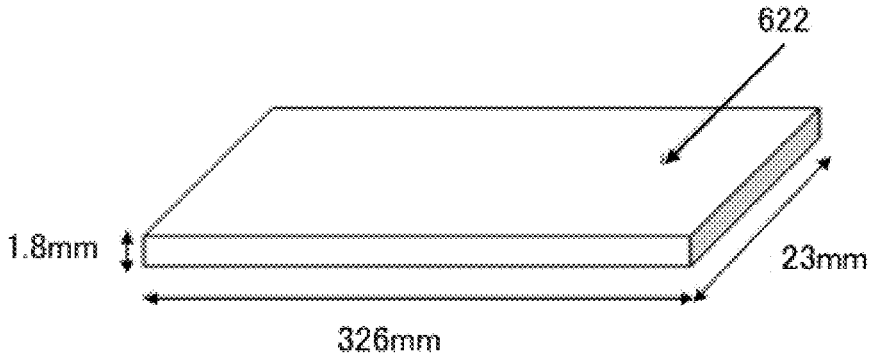
FIG. 13A is a schematic view describing a production method of a cleaning blade using a curable composition film as a surface layer (part 1)

First, a flat plate-shaped base 622 having a thickness of 1.8 mm and a size of 23 mm×326 mm was prepared (FIG. 13A).

Figure 13B:
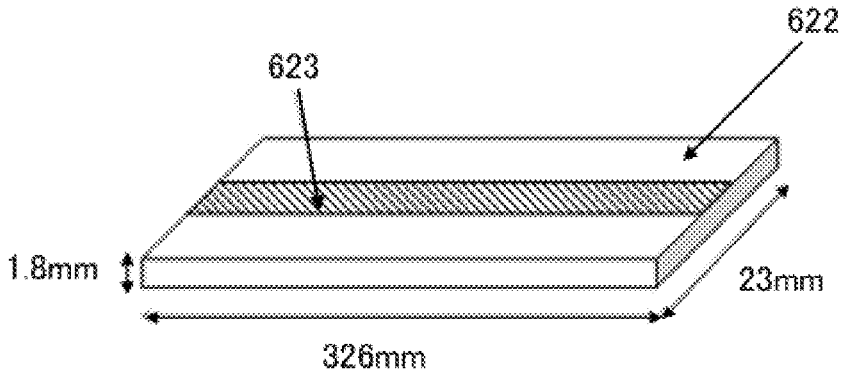
FIG. 13B is a schematic view describing the production method of the cleaning blade using the curable composition film as a surface layer (part 2)

Subsequently, a surface layer 623 that was a film of a cured product of a curable composition was arranged in the middle of the base 622 through heat sealing (FIG. 13B).

Figure 13C:
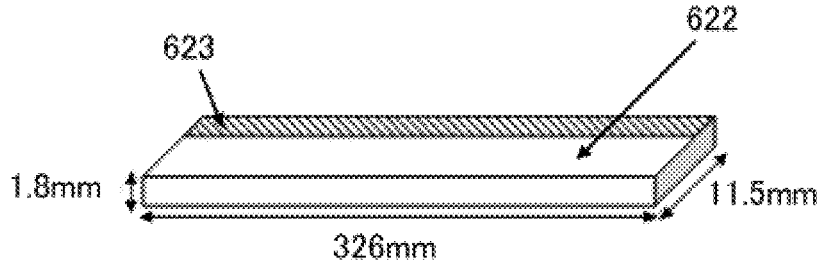
FIG. 13C is a schematic view describing the production method of the cleaning blade using the curable composition film as a surface layer (part 3)

Subsequently, the resultant was cut at the center to reduce the size in half, to thereby obtain a sheet of a strip shape in a size of 11.5 mm×326 mm (FIG. 13C).

An edge portion of the surface layer after the cutting corresponded to the distal-end ridge portion of the cleaning blade. A width of the surface layer was determined with a width of the film disposed by heat sealing.

Comparative Example 7

—Production of Cleaning Blade 33—

A bottom surface of Base 3 having a thickness of 1.8 mm in a strip shape was masked with leaving a 5 mm width from an edge surface of Base 3, and Curable Composition 5 was applied onto the bottom surface of Base 3 is a manner that a surface layer having an average film thickness of 20 μm was to be formed at the position that was 50 μm from the edge surface.

Specifically, Curable Composition 5 was applied multiple times onto an entire area of the bottom surface of Base 3 from the edge surface of Base 3 by spray coating at a spray-gun traveling-speed of 6 mm/s. Thereafter, the masking was removed, and the ultraviolet ray exposure was performed on the resultant using a high-pressure mercury-vapor lamp in a manner that the accumulated UV irradiation dose was to be 6,000 mJ/cm$^2$. The ultraviolet ray exposure was performed in a nitrogen atmosphere (irradiation atmosphere). Moreover, ultraviolet rays were applied by setting the distal-end ridge portion of the blade facing upwards relative to the high-pressure mercury-vapor lamp disposed at the top. In this manner, ultraviolet rays were efficiently applied to the distal-end ridge portion.

In the manner as described above, Cleaning Blade 33 was obtained.

Note at a position that gas 1 mm from the edge surface, as in Example 1, was not performed.

Similarly to Cleaning Blade 1 of Example 1, each of Cleaning Blades 2 to 33 produced was mounted in a color multifunction peripheral (IMAGIO MP C4500, available from Ricoh Company Limited), and image forming apparatuses of Examples 2 to 26 and Comparative Examples 1 to 7 were assembled. Moreover, the resultants were evaluated on the cleaning performance, nose, and abrasion width in the same manner as in Example 1. The results are presented in Table 7.

TABLE 6

| | | Cleaning blade | Base | Curable material for forming surface layer | Film thickness of edge portion of surface layer [μm] | Radius of curvature of edge portion [μm] | Region of surface layer [mm] | Martens hardness [N/mm$^2$] |
|---|---|---|---|---|---|---|---|---|
| Example | 1 | 1 | 1 | 1 | 25 | 2.2 | 3 | 27 |
| | 2 | 2 | 1 | 1 | 100 | 3.6 | 5 | 32 |
| | 3 | 3 | 1 | 2 | 32 | 2.8 | 1 | 15 |
| | 4 | 4 | 2 | 3 | 85 | 3.5 | 8 | 10 |
| | 5 | 5 | 2 | 3 | 65 | 1.9 | 0.5 | 5.1 |
| | 6 | 6 | 2 | 4 | 10 | 3.8 | 7 | 6.4 |
| | 7 | 7 | 2 | 4 | 35 | 1.8 | 10 | 25 |
| | 8 | 8 | 1 | 5 | 12 | 3.1 | 3 | 2.6 |
| | 9 | 9 | 3 | 1 | 25 | 2.2 | 3 | 29 |
| | 10 | 10 | 3 | 2 | 32 | 2.8 | 1 | 15 |
| | 11 | 11 | 4 | 4 | 10 | 3.8 | 7 | 7.5 |
| | 12 | 12 | 5 | 5 | 12 | 3.1 | 3 | 4.1 |
| | 13 | 13 | 3 | 1 | 45 | 3.1 | 6 | 30 |
| | 14 | 14 | 4 | 2 | 22 | 1.2 | 3 | 17 |
| | 15 | 15 | 4 | 1 | 10 | 2.8 | 10 | 20 |
| | 16 | 16 | 5 | 7 | 35 | 3.7 | 5 | 10 |

TABLE 6-continued

| | | Cleaning blade | Base | Curable material for forming surface layer | Film thickness of edge portion of surface layer [μm] | Radius of curvature of edge portion [μm] | Region of surface layer [mm] | Martens hardness [N/mm$^2$] |
|---|---|---|---|---|---|---|---|---|
| | 17 | 17 | 5 | 8 | 100 | 3.5 | 8 | 19 |
| | 18 | 18 | 3 | 9 | 84 | 3.9 | 0.5 | 12 |
| | 19 | 19 | 4 | 1 | 12 | 2.3 | 9 | 22 |
| | 20 | 20 | 5 | 1 | 50 | 3.7 | 5 | 27 |
| | 21 | 21 | 6 | 10 | 70 | 3.9 | 5 | 3.1 |
| | 22 | 22 | 6 | 13 | 50 | 2.5 | 10 | 30 |
| | 23 | 23 | 6 | 15 | 30 | 2.8 | 3 | 25 |
| | 24 | 24 | 4 | 15 | 30 | 2.8 | 2 | 25 |
| | 25 | 25 | 6 | 12 | 10 | 2.3 | 4 | 10 |
| | 26 | 26 | 6 | 11 | 100 | 3.5 | 8 | 8.6 |
| Comparative Example | 1 | 27 | 1 | — | — | 1.2 | — | 0.9 |
| | 2 | 28 | 2 | 1 | 120 | 3.8 | 6 | 30 |
| | 3 | 29 | 1 | 6 | 8 | 1.8 | 10 | 4.3 |
| | 4 | 30 | 2 | 3 | 0.3 | 2.1 | 3 | 1.2 |
| | 5 | 31 | 1 | 4 | 105 | 2.7 | 6 | 23 |
| | 6 | 32 | 6 | 14 | 150 | 3.5 | 3 | 32 |
| | 7 | 33 | 3 | 5 | 4 | 1.8 | 5 | 2.6 |

TABLE 7

| | | | After printing 50,000 sheets | | |
|---|---|---|---|---|---|
| | | Cleaning blade | Cleaning performance | Noise | Abrasion width [μm] |
| Example | 1 | 1 | B | I | 6 |
| | 2 | 2 | B | I | 8 |
| | 3 | 3 | B | I | 12 |
| | 4 | 4 | B | I | 16 |
| | 5 | 5 | B | I | 10 |
| | 6 | 6 | C | I | 9 |
| | 7 | 7 | B | I | 12 |
| | 8 | 8 | C | I | 10 |
| | 9 | 9 | A | I | 4 |
| | 10 | 10 | A | I | 8 |
| | 11 | 11 | B | I | 9 |
| | 12 | 12 | B | I | 8 |
| | 13 | 13 | A | I | 5 |
| | 14 | 14 | A | I | 12 |
| | 15 | 15 | B | I | 7 |
| | 16 | 16 | B | I | 9 |
| | 17 | 17 | B | I | 18 |
| | 18 | 18 | B | I | 7 |
| | 19 | 19 | A | I | 4 |
| | 20 | 20 | B | I | 10 |
| | 21 | 21 | C | I | 4 |
| | 22 | 22 | B | I | 3 |
| | 23 | 23 | B | I | 3 |
| | 24 | 24 | A | I | 2 |
| | 25 | 25 | B | I | 3 |
| | 26 | 26 | B | I | 5 |
| Comparative Example | 1 | 27 | D | II | Could not be measured |
| | 2 | 28 | D | I | 8 |
| | 3 | 29 | C | II | 10 |
| | 4 | 30 | C | II | 7 |
| | 5 | 31 | D | I | 20 |
| | 6 | 32 | D | I | 6 |
| | 7 | 33 | D | II | 12 |

It was found in the cleaning blades of Example 1 to 26 that an excellent cleaning performance was obtained even when each of the cleaning blades was used over a long period because the base rubber was not exposed with abrasion, and generation of noise was able to be suppressed, since the average film thickness of the surface layer at the contact part was 10 μm or greater but 100 μm or less. Moreover, out of color registration did not occur even in the image forming apparatus of a tandem system.

In Comparative Example 1, on the other hand, a movement of the contact part of the elastic member was not be able to be suppressed and a recess was formed through abrasion, and therefore a cleaning failure and noise were caused, since a surface layer was not formed at the contact part.

Since the average film thickness of the surface layer of the contact part was not in the range of 10 μm or greater but 100 μm or less in Comparative Examples 2 to 7, moreover, a cleaning failure or noise was generated due to use over time. In Comparative Example 2, the trackability of the elastic member to the photoconductor was impaired because the average film thickness of the surface layer was too thick and therefore a cleaning failure occurred. In Comparative Examples 3 and 4, the results were not desirable because the abrasion width became larger than the average film thickness of the surface layer after the use over a long period and therefore the elastic member of the base was exposed.

In Comparative Example 5, the average film thickness of the surface layer was thick, the film was cracked after the use over a long period, and therefore a cleaning failure occurred.

In Comparative Examples 4 and 7, moreover, the average film thicknesses at the position that was 5 μm away from the blade contact part (distal-end ridge portion) were 0.3 μm in Comparative Example 4 and 4 μm in Comparative Example 7, but the average film thicknesses at the position that was 50 μm away from the blade contact part (distal-end ridge portion) were 1 μm in Comparative Example 4 and 20 μm in Comparative Example 7.

<Additional Evaluation>

Printing of additional 30,000 sheets was performed with Cleaning Blades 13 to 20 of Examples 13 to 20 under the same conditions after the evaluations of Table 7, and evaluations after printing of the total 80,000 sheets were also performed. The results are presented in Table 8.

TABLE 8

| | | | After printing 80,000 sheets | | |
|---|---|---|---|---|---|
| | | Cleaning blade | Cleaning performance | Noise | Abrasion width [μm] |
| Example | 13 | 13 | B | I | 8 |
| | 14 | 14 | B | I | 18 |
| | 15 | 15 | C | I | 9 |
| | 16 | 16 | C | I | 12 |
| | 17 | 17 | C | I | 24 |
| | 18 | 18 | C | I | 10 |
| | 19 | 19 | B | I | 8 |
| | 20 | 20 | B | I | 15 |

Since the Martens hardness of the base was 2.0 N/mm$^2$ or greater in Examples 13 to 20, the edge portion of the base was hardly deformed, cracks were not formed in the surface layer even after the edge portion was used over a long period, and a cleaning performance was able to be maintained.

<1> A cleaning blade including an elastic member configured to be in contact with a surface of a cleaning-target member to remove deposited matter deposited on the surface of the cleaning-target member, wherein the elastic member includes a base and a surface layer formed of a cured product of a curable composition, the surface layer is formed on at least, part of a bottom surface of the base including a contact part to be in contact with the cleaning-target member, where the bottom surface of the base is a surface of the base facing a downstream side along a traveling direction of the cleaning-target member relative to the contact part, and an average film thickness of the surface layer at the contact part is 10 μm or greater but 100 μm or less.

<2> The cleaning blade according to <1>, wherein the cured product of the curable composition is a cured product of an epoxy resin or a cured product of a resin having a polyethylene skeleton.

<3> The cleaning blade according to <1> or <2>, wherein a radius of curvature of the surface layer at the contact part is 3.5 μm or less.

<4> The cleaning blade according to any one of <1> to <3>, wherein the surface layer formed on the bottom surface of the base is formed in a region that is apart from the contact part by 1 mm or greater but 7 mm or less.

<5> The cleaning blade according to any one of <1> to <4>, wherein Martens hardness of an edge surface of the base measured by a microhardness meter is 2.0 N/mm$^2$ or greater.

<6> The cleaning blade according to any one of <1> to <5>, wherein Martens hardness of an edge surface of the base measured by a microhardness meter is 3 N/mm$^2$ or greater but 30 N/mm$^2$ or less.

<7> A process cartridge including:

an image bearer; and a cleaning unit configured to remove a toner remaining on the image bearer, wherein the cleaning unit includes the cleaning blade according to any one of <1> to <6>.

<8> An image forming apparatus including:

an image bearer;

a charging unit configured to charge a surface of the image bearer;

an exposure unit configured to expose the image bearer charged to light to form an electrostatic latent image;

a developing unit configured to develop the electrostatic latent image with a toner to form a visible image;

a transfer unit configured to transfer the visible image to a recording medium;

a fixing unit configured to fix a transfer image transferred to the recording medium; and a cleaning unit configured to remove the toner remaining on the image bearer, wherein the cleaning unit includes the cleaning blade according to any one of <1> to <6>.

What is claimed is:

1. A cleaning blade comprising an elastic member configured to contact a surface of a cleaning-target member to remove deposited matter deposited on the surface of the cleaning-target member, the elastic member including a base and a surface layer formed of a cured product of a curable composition, wherein the surface layer is formed on at least part of a bottom surface of the base and includes a contact part to be in contact with the cleaning-target member, wherein the bottom surface of the base is a surface of the base facing a downstream side along a traveling direction of the cleaning-target member relative to the contact part, and wherein an average film thickness of the surface layer at the contact part is 10 μm or greater but 100 μm or less.

2. The cleaning blade according to claim 1, wherein the cured product of the curable composition is a cured product of an epoxy resin or a cured product of a resin having a polyethylene skeleton.

3. The cleaning blade according to claim 1, wherein a radius of curvature of the surface layer at the contact part is 3.5 μm or less.

4. The cleaning blade according to claim 1, wherein the surface layer formed on the bottom surface of the base is formed in a region that is apart from the contact part by 1 mm or greater but 7 mm or less.

5. The cleaning blade according to claim 1, wherein Martens hardness of an edge surface of the base measured by a microhardness meter is 2.0 N/mm$^2$ or greater.

6. The cleaning blade according to claim 1, wherein Martens hardness of an edge surface of the base measured by a microhardness meter is 3 N/mm$^2$ or greater but 30 N/mm$^2$ or less.

7. A process cartridge comprising:

an image bearer; and a cleaning unit configured to remove a toner remaining on the image bearer, wherein the cleaning unit includes the cleaning blade according to claim 1.

8. An image forming apparatus comprising:

an image bearer;

a charging unit configured to charge a surface of the image bearer;

an exposure unit configured to expose the image bearer charged to light to form an electrostatic latent image;

a developing unit configured to develop the electrostatic latent image with a toner to form a visible image;

a transfer unit configured to transfer the visible image to a recording medium;

a fixing unit configured to fix a transfer image transferred to the recording medium; and a cleaning unit configured to remove the toner remaining on the image bearer, wherein the cleaning unit includes the cleaning blade according to claim 1.

9. The cleaning blade according to claim 1, wherein the contact part of the surface layer is a distal-end ridge portion of the elastic member adjacent to an edge of the base at which the bottom surface of the base meets an adjacent surface of the base.

10. A cleaning blade comprising:

an elastic member configured to contact a surface of a cleaning-target member to remove deposited matter deposited on the surface of the cleaning-target member, the elastic member including a base and a surface layer formed of a cured product of a curable composition, wherein the surface layer is formed on at least part of a bottom surface of the base and includes a contact part to be in contact with the cleaning-target member, the bottom surface of the base is a surface of the base facing a downstream side along a traveling direction of the cleaning-target member relative to the contact part, and an average film thickness of the surface layer at the contact part is 10 μm or greater but 100 μm or less, and wherein the cured product of the curable composition forming the surface layer of the elastic member includes a resin having a polyethylene skeleton.

11. A process cartridge comprising:

an image bearer; and a cleaning unit configured to remove a toner remaining on the image bearer, wherein the cleaning unit includes the cleaning blade according to claim 10.

12. An image forming apparatus comprising:

an image bearer;

a charging unit configured to charge a surface of the image bearer;

an exposure unit configured to expose the image bearer charged to light to form an electrostatic latent image;

a developing unit configured to develop the electrostatic latent image with a toner to form a visible image;

a transfer unit configured to transfer the visible image to a recording medium;

a fixing unit configured to fix a transfer image transferred to the recording medium; and a cleaning unit configured to remove the toner remaining on the image bearer, wherein the cleaning unit includes the cleaning blade according to claim 10.

* * * * *